US007977040B2

(12) United States Patent
Yoshioka et al.

(10) Patent No.: US 7,977,040 B2
(45) **Date of Patent: *Jul. 12, 2011**

(54) HEAT DEVELOPABLE PHOTOSENSITIVE MATERIAL

(75) Inventors: Yasuhiro Yoshioka, Kanagawa (JP); Takayoshi Oyamada, Kanagawa (JP); Eiichi Okutsu, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 669 days.

This patent is subject to a terminal disclaimer.

(21) Appl. No.: 10/270,510

(22) Filed: Oct. 16, 2002

(65) Prior Publication Data

US 2003/0129553 A1 Jul. 10, 2003

(30) Foreign Application Priority Data

Oct. 19, 2001 (JP) ..... 2001-321988

(51) Int. Cl.
*G03C 1/498* (2006.01)

(52) U.S. Cl. ..... 430/619; 430/531; 430/607; 430/620

(58) Field of Classification Search ..... 430/619, 430/620, 531, 607
See application file for complete search history.

(56) References Cited

U.S. PATENT DOCUMENTS

| | | | | |
|---|---|---|---|---|
| 2,910,377 | A | 10/1959 | Owen et al. | |
| 3,152,904 | A | 10/1964 | Sorensen et al | |
| 4,152,160 | A * | 5/1979 | Ikienoue et al. | 430/495.1 |
| 4,395,484 | A | 7/1983 | McCarney | |
| 4,784,939 | A | 11/1988 | Van Pham et al. | |
| 5,698,380 | A * | 12/1997 | Toya | 430/363 |
| 6,090,538 | A | 7/2000 | Arai et al. | |
| 6,146,823 | A | 11/2000 | Katoh | |
| 6,165,707 | A | 12/2000 | Hirano et al. | |
| 6,174,663 | B1 | 1/2001 | Kato | |
| 6,458,505 | B2 | 10/2002 | Ito | |
| 6,582,897 | B2 * | 6/2003 | Yoshioka | 430/619 |
| 2003/0232295 | A1 * | 12/2003 | Fukui et al. | 430/620 |

FOREIGN PATENT DOCUMENTS

| | | | |
|---|---|---|---|
| EP | 1041433 | * | 10/2000 |
| EP | 1096310 | * | 5/2001 |
| JP | B 43-4924 | | 2/1968 |
| JP | A-09-281637 | | 10/1997 |
| JP | A-09-329865 | | 12/1997 |
| JP | A-10-197989 | | 7/1998 |
| JP | 2000-010230 | A | 1/2000 |
| JP | A-2000-122220 | | 4/2000 |
| JP | A 2000-171938 | | 6/2000 |
| JP | A 2000-310832 | | 11/2000 |
| JP | 2000-347335 | A | 12/2000 |
| JP | 2000-352788 | A | 12/2000 |
| JP | 2000-356834 | A | 12/2000 |
| JP | 2001-005136 | A | 1/2001 |
| JP | 2001-013628 | A | 1/2001 |
| JP | 2001-066727 | A | 3/2001 |
| JP | 2001-092098 | A | 4/2001 |
| JP | 2001-166418 | A | 6/2001 |
| JP | A 2001-201817 | | 7/2001 |
| JP | 2001-249426 | A | 9/2001 |
| JP | 2001-255625 | A | 9/2001 |
| JP | 2001-264921 | A | 9/2001 |
| JP | 2001-264935 | A | 9/2001 |

* cited by examiner

*Primary Examiner* — Thorl Chea
(74) *Attorney, Agent, or Firm* — Sheldon J. Moss; Chad M. Herring

(57) ABSTRACT

The present invention provides a heat developable photosensitive material comprising at least a photosensitive silver halide, a non-photosensitive organic silver salt, a reducing agent for silver ions and binder on one surface of a support.

13 Claims, No Drawings

HEAT DEVELOPABLE PHOTOSENSITIVE MATERIAL

BACKGROUND OF THE INVENTION

1. Field of the Invention

The present invention generally relates to a heat developable photosensitive material, and in particular to a heat developable photosensitive material having high sensitivity and high heat development activity, providing a high image density even if the silver content thereof is small, being excellent in image preservation, and showing low fogging.

2. Description of the Related Art

Reduction of the amount of waste which is produced when films for medical diagnosis and photographic printing are processed has been increasingly required in recent years in view of environmental preservation and for saving work spaces. Accordingly, technologies related to heat developable photosensitive materials are required for providing films for medical diagnosis and photographic printing. Such films can be efficiently exposed to light by laser image setter or laser imager to form clear and black images with high resolution and sharpness. No liquid chemicals are needed when the heat developable photosensitive material is processed, making it possible to supply to customers a heat development system that is more simple and friendly to the environment.

While similar advantages are required in general purpose imaging materials, cold black-tone images are preferable, particularly for use in medical diagnosis, when considering availability for easy diagnosis, since high image quality with excellent sharpness and granular properties is necessary for attaining the required fine depiction. Although various hard copy systems taking advantage of pigments and dyes, such as an ink-jet printer and electrophotography, are commercially available today as general imaging systems, none of them are satisfactory as output systems for medical images.

Examples of the heat imaging system utilizing organic silver salt are disclosed in U.S. Pat. Nos. 3,152,904 and 3,457,075, and described in "Thermally Processed Silver System", Imaging Processes and Materials, Neblette Vol. 8, written by D. Klosterboer, edited by J. Sturge, V. Walworth and A. Shepp, Capt. 9, p 279, 1989.

Generally, the heat developable photosensitive material has a photosensitive layer in which a photocatalyst (e.g., silver halide), a reducing agent, a reducible silver salt (e.g., an organic silver salt) and, if necessary, a tone control agent that controls tone of silver is dispersed in a binder matrix.

The heat developable photosensitive material is heated at a high temperature (for example 80° C. or more) after image-wise exposure to cause an oxidation-reduction reaction between the reducible silver salt which functions as an oxidizing agent and a reducing agent and to form a back silver image. The oxidation-reduction reaction is accelerated by the catalytic action of a latent image of silver halide generated by exposure. Consequently, the black silver image is formed in the exposed area. These procedures are disclosed in many references such as U.S. Pat. No. 2,910,377 and Japanese Patent Application Publication (JP-B) No. 43-4924.

In the heat developable photosensitive material, it is preferable that the oxidation-reduction reaction between the reducible silver salt and the reducing agent is proceeded at a feasibly acceptable temperature and reaction time in order to obtain an acceptable image density. However, there is a still need for the heat developable photosensitive material having a high sensitivity and high heat development activity, providing high image density even if a silver content thereof is small, being excellent in image preservation, and showing low levels of fogging.

In particular, reduction of the amount of the silver contained in the photosensitive material is desired in view of improved image stability against light after the development process.

Since no fixing process of the organic silver salt is employed in the heat developable photosensitive material using the organic silver salt, silver images may appear by light or heat after forming the silver image by heating. Such unnecessary images are not formed under ordinary conditions of use. However, when the preservation conditions are very severe for the heat developable photosensitive material, for example when processed films are placed in a hot vehicle during summer for transportation, troubles such as color changes throughout the film or transfer of characters printed on a bag as a container of the film onto the film, or a so-called fogging, may occur.

SUMMARY OF THE INVENTION

The object of the present invention is to solve the problems described above and to provide a heat developable photosensitive material that has a high sensitivity and a high heat development activity, providing high image density even if the silver content thereof is small, is excellent in image preservation, and shows low levels of fogging.

The invention provides a heat developable photosensitive material comprising at least a photosensitive silver halide, a non-photosensitive organic silver salt, a reducing agent for silver ions and binder on one surface of a support, wherein the non-photosensitive organic silver salt contains 53 mol % to 85 mol % of silver behenate; and the total amount of silver of the non-photosensitive organic silver salt and photosensitive silver halide is 0.1 to 1.9 g/m$^2$; and the reducing agent includes at least one polyphenol compounds represented by the following General formula (1); and any layer that is provided on a support side with the photosensitive silver halide contains an aromatic carboxylic acid compound represented by the following General formula (2):

General formula (1)

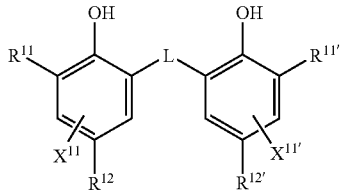

General formula (2)

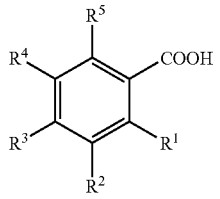

In General formula (1), each of $R^{11}$ and $R^{11'}$ independently represents an alkyl group, each of $R^{12}$ and $R^{12'}$ independently represents a hydrogen atom or group that can bond to a benzene ring, and each of $X^{11}$ and $X^{11'}$ independently represents a hydrogen atom or group that can bond to a benzene ring; and $R^{11}$ and $X^{11}$, $R^{11'}$, and $X^{11'}$, $R^{12}$ and $X^{11}$, and $R^{12'}$ and $X^{11'}$, respectively, may bond to each other to form a ring; and L represents a —S— group or a —$CHR^{13}$— group; and $R^{13}$ represents a hydrogen atom or an alkyl group.

In General formula (2), each of $R^1$ to $R^5$ independently represents a hydrogen atom or group that can bond to a benzene ring; and at least one of $R^1$ to $R^5$ represents a non-dissociating substituent that bonds to the benzene ring via a carbon atom, nitrogen atom, oxygen atom, sulfur atom or phosphorous atom.

DETAILED DESCRIPTION OF THE PREFERRED EMBODIMENTS

The heat developable photosensitive material of the invention will be described in detail hereinafter.

The heat developable photosensitive material of the invention contains at least a photosensitive silver halide, a non-photosensitive organic silver salt, a reducing agent for silver ions and a binder on one surface of a support. In the invention, the non-photosensitive organic silver salt contains 53 mol % to 85 mol % of silver behenate with the total amount of applied silver of the non-photosensitive organic silver salt and the photosensitive silver halide being 0.1 to 1.9 g/$m^2$, and the reducing agent contains at least one polyphenol compounds represented by the following General formula (1). An aromatic carboxylic acid compound represented by the following General formula (2) is contained in any layer that is provided on the support side with a photosensitive silver halide. Each element of the heat developable photosensitive material of the invention will be described in detail hereinafter.

The heat developable photosensitive material of the invention contains at least one of the polyphenol compounds represented by the following General formula (1).

General formula (1)

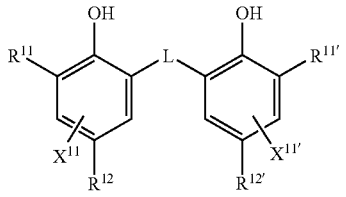

In General formula (1), each of $R^{11}$ and $R^{11'}$ independently represents an alkyl group, each of $R^{12}$ and $R^{12'}$ independently represents a hydrogen atom or a group that can bond to a benzene ring, and each of $X^{11}$ and $X^{11'}$ independently represents a hydrogen atom or a group that can bond to a benzene ring. $R^{11}$ and $X^{11}$, $R^{11'}$ and $X^{11'}$, $R^{12}$ and $X^{11}$, and $R^{12'}$ and $X^{11'}$, respectively, may bond to each other to form a ring. L represents a —S— group or a —$CHR^{13}$— group. $R^{13}$ represents a hydrogen atom or an alkyl group.

The polyphenol compounds represented by General formula (1) will be described in detail hereinafter.

In General formula (1), each of $R^{11}$ and $R^{11'}$ independently represents an alkyl group and is preferably a substituted or unsubstituted alkyl group having 1 to 20 carbon atoms. While the substituents of the alkyl group is not particularly restricted, preferable examples thereof include an aryl group, a hydroxyl group, an alkoxy group, an aryloxy group, an alkylthio group, an arylthio group, an acylamino group, a sulfonamide group, a sulfonyl group, a phosphoryl group, an acyl group, a carbamoyl group, an ester group and a halogen atom.

Secondary or tertiary alkyl groups having 3 to 15 carbon atoms are preferable as $R^{11}$ and $R^{11'}$ in the general formula (1), and preferable examples thereof include isopropyl group, isobutyl group, t-butyl group, t-amyl group, t-octyl group, cyclohexyl group, cyclopentyl group, 1-methylcyclohexyl group and 1-methylcyclopropyl group. Secondary or tertiary alkyl groups having 3 to 8 carbon atoms are more preferable as $R^{11}$ and $R^{11'}$. t-Butyl group, t-amyl group and 1-methylcyclohexyl group are further preferable among them, and t-butyl group is most preferable.

Each of $R^{12}$ and $R^{12'}$ independently is a hydrogen atom or a substituent that can bond to a benzene ring in General formula (1). An alkyl group is preferable as $R^{12}$ and $R^{12'}$, and the alkyl group having 1 to 20 carbon atoms is more preferable. Specific examples of the preferable alkyl group include methyl group, ethyl group, propyl group, butyl group, isopropyl group, t-butyl group, t-amyl group, cyclohexyl group, 1-methylcyclohexyl group, benzyl group, methoxymethyl group and methoxyethyl group, and methyl group, ethyl group, propyl group and isopropyl group, and t-butyl group are more preferable.

Each of $X^{11}$ and $X^{11'}$ independently represents a hydrogen atom or a group that can bond to a benzene ring in General formula (1). Preferable examples of the group that can bond to the benzene ring include an alkyl group, aryl group, halogen atom, alkoxy group and acylamino group. A hydrogen atom, halogen atom and alkyl group are preferable as $X^{11}$ and $X^{11'}$, and the hydrogen atom is more preferable.

$R^{11}$ and $X^{11}$, $R^{11'}$ and $X^{11'}$, $R^{12}$ and $X^{11}$, and $R^{12'}$ and $X^{11'}$, respectively, may bond to each other to form a ring in General formula (1).

L represents a —S— group or a —$CHR^{13}$— group in the General formula (1). The —$CHR^{13}$— group is preferable as L.

$R^{13}$ represents a hydrogen atom or an alkyl group in General formula (1), and is preferably a hydrogen atom or an alkyl group having 1 to 20 carbon atoms. The alkyl group represented by $R^{13}$ may have at least one substituent.

Preferable examples of the unsubstituted alkyl group represented by $R^{13}$ include methyl group, ethyl group, propyl group, butyl group, heptyl group, undecyl group, isopropyl group, 1-ethylpentyl group and 2,4,4-trimethylpentyl group.

Examples of the substituent of substituted alkyl groups represented by $R^{13}$ are the same as the substituents of $R^{11}$, and preferable examples thereof include a halogen atom, alkoxy group, alkylthio group, aryloxy group, arylthio group, acylamino group, sulfonamide group, sulfonyl group, phosphoryl group, oxycarbonyl group, carbamoyl group and sulfamoyl group.

A hydrogen atom or an alkyl group having 1 to 15 carbon atoms is preferable as $R^{13}$, and a secondary alkyl group having 1 to 12 carbon atoms is more preferable. Preferable examples of the alkyl group represented by $R^{13}$ include methyl group, ethyl group, propyl group, isopropyl group and 2,4,4-trimethylpentyl group.

The hydrogen atom, methyl group, propyl group or isopropyl group is particularly preferable as $R^{13}$.

An alkyl group having 2 to 5 carbon atoms is preferable, and an ethyl group or a propyl group is more preferable, and the ethyl group is most preferable as $R^{12}$ and $R^{12'}$ when $R^{13}$ is a hydrogen atom in the General formula (1).

A methyl group is preferable as $R^{12}$ and $R^{12'}$ when $R^{13}$ is a primary or secondary alkyl group having 1 to 12 carbon atoms. The methyl group, ethyl group, propyl group and isopropyl group are more preferable, and the methyl group, ethyl group and propyl group are most preferable as the primary and secondary alkyl group having 1 to 12 carbon atoms represented by $R^{13}$.

The secondary alkyl group is preferable, and the secondary alkyl group having 3 to 12 carbon atoms is more preferable as $R^{13'}$ when $R^{11}$, $R^{11'}$, $R^{12}$ and $R^{12'}$ all represent methyl groups. The isopropyl group, isobutyl group and 1-ethylpentyl group are preferable, and the isopropyl group is most preferable as the secondary alkyl group represented by $R^{13}$.

The polyphenol compound represented by General formula (1) is preferably any of the following compounds:

(1) Compounds in which each of $R^{11}$ and $R^{11'}$ independently is a secondary or tertiary alkyl group; each of $R^{12}$ and $R^{12'}$ independently is an alkyl group; L is a —S— group or a —$CHR^{13}$— group (wherein $R^{13}$ represents a hydrogen atom or an alkyl group); and both $X^{11}$ and $X^{11'}$ are hydrogen atoms;

(2) Compounds in which each of $R^{11}$ and $R^{11'}$ independently is a tertiary alkyl group; each of $R^{12}$ and $R^{12'}$ independently is an alkyl group; and L is a —S— group or a —$CHR^{13}$— group (wherein $R^{13}$ represents an alkyl group);

(3) Compounds in which each of $R^{11}$ and $R^{11'}$ independently is a tertiary alkyl group; each of $R^{12}$ and $R^{12'}$ independently is an alkyl group; and L is a —S— group or a —$CHR^{13}$— group (wherein $R^{13}$ represents an alkyl group); and (4) Compounds in which $R^{11}$ and $R^{11'}$ are methyl groups; each of $R^{12}$ and $R^{12'}$ independently is an alkyl group; and L is a —S— group or a —$CHR^{13}$— group (wherein $R^{13}$ represents a secondary alkyl group).

Examples of the polyphenol compounds represented by the General formula (1) (compounds 1-1 to 1-20) are illustrated below, but the invention is by no means restricted thereto.

(I-1)

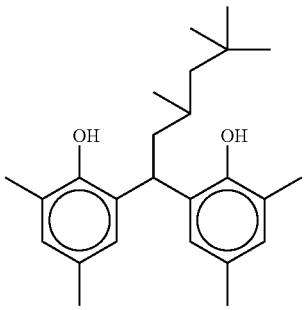

(I-2)

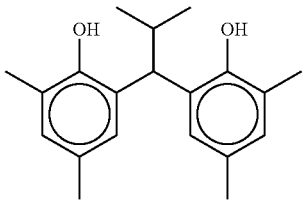

(I-3)

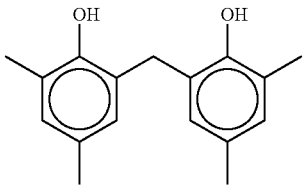

-continued (I-4)

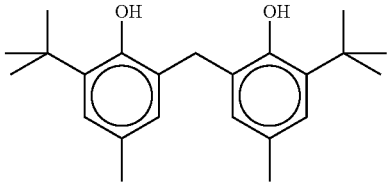

(I-5)

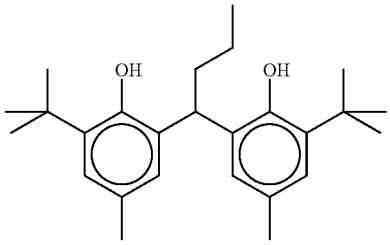

(I-6)

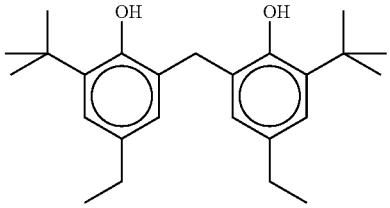

(I-7)

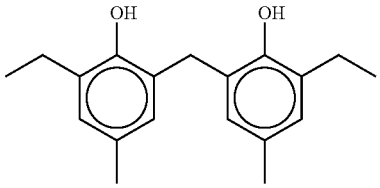

(I-8)

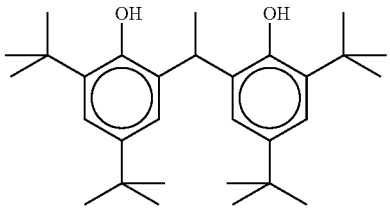

(I-9)

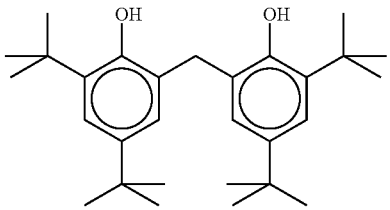

(I-10)

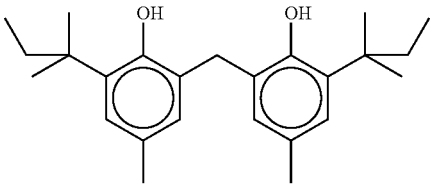

-continued (I-11)

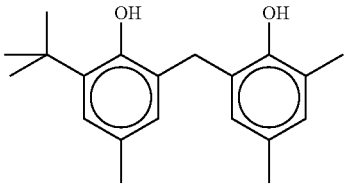

(I-12)

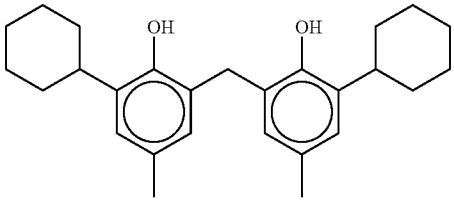

(I-13)

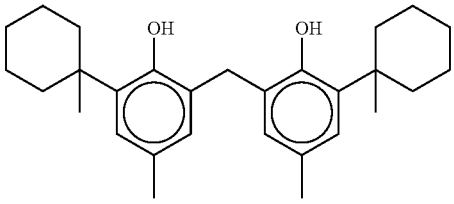

(I-14)

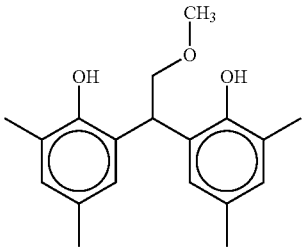

(I-15)

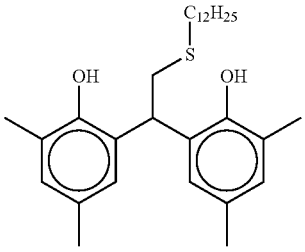

(I-16)

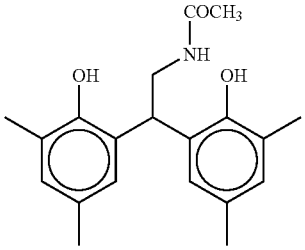

(I-17)

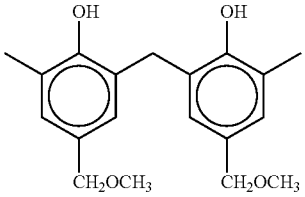

-continued (I-18)

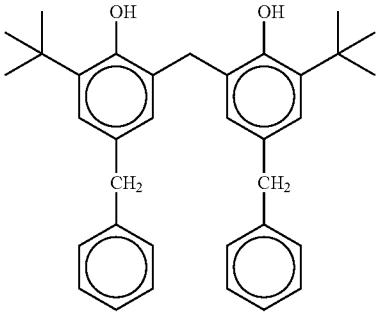

(I-19)

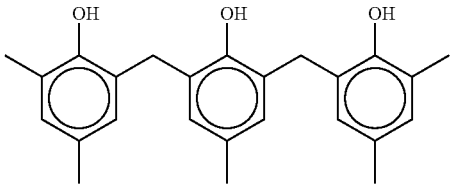

(I-20)

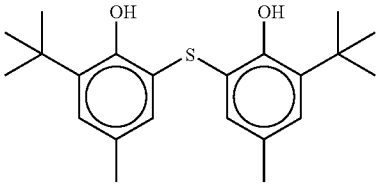

The amount of reducing agent represented by General formula (1) is preferably 0.01 to 5.0 g/m$^2$, more preferably 0.1 to 3.0 g/m$^2$, further preferably 0.2 to 1.8 g/m$^2$, and particularly preferably 0.5 to 1.5 g/m$^2$. The reducing agent is preferably added in a proportion of 5 to 50 mol %, and more preferably in a proportion of 10 to 40 mol %, relative to 1 mole of silver in the surface having a photosensitive silver halide. The polyphenol compound, as a reducing agent, represented by General formula (1) is preferably added to the photosensitive layer (imaging layer).

The reducing agent may be added to the heat developable photosensitive material by applying to a support a coating solution containing it in any form such as a solution, an emulsion or a dispersion of fine solid particles.

Examples of an emulsification method well known in the art include a method in which the reducing agent is dissolved in an oil such as dibutyl phthalate, tricresyl phosphate, glycerol triacetate or diethyl phthalate with an auxiliary solvent such as ethyl acetate or cyclohexanone, followed by mechanical dispersion of the emulsion.

Examples of a method for dispersing fine solid particles include a method in which a powder of the reducing agent is dispersed in an appropriate solvent such as water by means of a ball mill, colloid mill, vibration ball mill, sand mill, jet mill, roller mill or ultrasonic wave to prepare a solid dispersion. A protective colloid (e.g., polyvinyl alcohol) and a surfactant (e.g., an anionic surfactant such as sodium triisopropylnaphthalenesulfonate (a mixture of compounds having different substitution sites for three isopropyl groups)) may be used in preparing the dispersion. A preservative such as sodium benzoisothiazolinone may be added to an aqueous dispersion.

A reducing agent other than those represented by General formula (1) may be used, if necessary, in the heat developable photosensitive material so long as it does not adversely affect the effect of the invention.

The heat developable photosensitive material of the invention contains an aromatic carboxylic acid compound represented by the following General formula (2) in any layer that is provided on the surface of the support side with a photosensitive silver halide.

General formula (2)

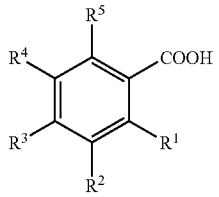

The aromatic carboxylic acid compound represented by General formula (2) will be described in detail hereinafter.

In General formula (2), each of $R^1$ to $R^5$ independently represents a hydrogen atom or a group that can bond to a benzene ring. At least one of $R^1$ to $R^5$ represents a non-dissociating substituent that bonds to the benzene ring via a carbon, nitrogen, oxygen, sulfur or phosphorous atom.

Examples of the group substituent bonding to the benzene ring via a carbon atom include a straight, branched or cyclic alkyl group, alkenyl group, alkynyl group, aryl group, acyl group, alkoxycarbonyl group, aryloxycarbonyl group, carbamoyl group, cyano group, heterocyclic group, sulfonylcarbainoyl group, acylcarbamoyl group, sulfamoylcarbamoyl group, carbazoyl group, oxalyl group, oxamoyl group and thiocarbamoyl group.

Examples of the substituents bonding to the benzene ring via an oxygen atom include an alkoxy group, aryloxy group, heterocyclic oxy group, acyloxy group, (alkoxy or aryloxy) carbonyloxy group, carbamoyloxy group, sulfonyloxy group and phosphonyloxy group.

Examples of the substituent bonding to the benzene ring via a nitrogen atom include amino group, nitro group, hydrazino group, heterocyclic group, acylamino group, (alkoxy or aryloxy) carbonylamino group, sulfonylamino group, sulfamoylamino group, semicarbazide group, thiosemicarbazide group, oxamoylamino group, ureido group, thioureido group, sulfonylureido group, acylureido group, acylsulfamoyl group, phosphorylamino group and imide group.

Examples of the substituent bonding to the benzene ring via a sulfur atom include alkylthio group, arylthio group, disulfide group, sulfonyl group, sulfinyl group, sulfamoyl group, acylsulfamoyl group and heterocyclic thio group.

Examples of the substituent bonding to the benzene ring via a phosphor atom include phosphonyl group and phosphinyl group.

In General formula (2), examples of the group that can bond to benzene and is represented by $R^1$, $R^2$, $R^3$, $R^4$ and $R^5$ and other than those described above include, for example, a halogen atom.

Groups represented by $R^1$, $R^2$, $R^3$, $R^4$ and $R^5$ in General formula (2) may be also substituted with the substituent as described above.

The aromatic carboxylic acid compound represented by General formula (2) has only one carboxylic group in the molecule for manifesting appropriate acidity and hydrophilicity. The compound is never substituted with a strong dissociation group having a pKa value of 6 or less except the carboxylic group.

At least one of the groups represented by $R^1$, $R^2$, $R^3$, $R^4$ and $R^5$ in General formula (2) is preferably selected from an alkyl group having 1 to 30 carbon atoms (e.g., methyl group, ethyl group, isopropyl group, butyl group, cyclohexyl group, n-octyl group, 3,5,5-trimethylhexyl group and n-dodecyl group), an aryl group having 6 to 30 carbon atoms (e.g., phenyl group, naphthyl group, tolyl group, xylyl group and 3,5-dichlorophenyl group), a heterocyclic group having 5 to 30 carbon atoms (e.g., pyridyl group, quinolyl group, piperidyl group and pyrimidyl group), an alkoxy group having 1 to 30 carbon atoms (e.g., methoxy group, propoxy group, butoxy group, methoxyethoxy group, dodecyloxy group and 2-ethylhexyloxy group), an aryloxy group having 6 to 30 carbon atoms (e.g., phenoxy group, 1-naphthoxy group, cresyl group, 3-chlorophenoxy group and 4-t-octylphenoxy group), a sulfonyloxy group having 1 to 30 carbon atoms (e.g., methanesulfonyloxy group, butanesulfonyloxy group, benzenesulfonyloxy group and 4-methylbenzenesulfonyloxy group), an acyl group having 2 to 30 carbon atoms (e.g., acetyl group, pivaloyl group, benzoyl group, 4-chlorobenzoyl group and 3,5-dimethylbenzoyl group), an acyloxy group having 2 to 30 carbon atoms (e.g., acetyloxy group, benzoyloxy group, pivaloyloxy group, 3-methylbenzoyloxy group, 4-methoxybenzoyloxy group and 2-chlorobenzoyloxy group), an alkoxycarbonyl group having 2 to 30 carbon atoms (e.g., methoxycarbonyl group, ethoxycarbonyl group, hexyloxycarbonyl group and dodecyloxycarbonyl group), an aryloxycarbonyl group having 2 to 30 carbon atoms (e.g., phenoxycarbonyl group, benzoyloxycarbonyl group and 3,4-dichlorophenyloxycarbonyl group), an acylamino group having 1 to 30 carbon atoms (e.g., acetylamino group, benzoylamino group and N,N-dimethylcarbamoylamino group), a sulfonylamino group having 1 to 30 carbon atoms (e.g., methanesulfonylamino group, benzenesulfonylamino group and p-toluenesulfonylamino group), a carbamoyl group having 1 to 30 carbon atoms (e.g., dimethylcarbamoyl group, diethylcarbamoyl group, dibutylcarbamoyl group, octylcarbamoyl group, phenylcarbamoyl group and N-methylphenylcarbaoyl group), a sulfamoyl group having 1 to 30 carbon atoms (e.g., dimethylsulfamoyl group, octylsulfamoyl group and phenylsulfamoyl group), and a sulfonyl group having 1 to 30 carbon atoms (e.g., methanesulfonyl group, octanesulfonyl group, dodecanesulfonyl group, benzenesulfonyl group, toluenesulfonyl group and xylenesulfonyl group).

Among them, it is particularly preferable that at least one of $R^1$, $R^2$, $R^3$, $R^4$ and $R^5$ is an alkoxy group, aryloxy group, acyloxy group, alkylsulfonyloxy group, arylsulfonyl oxy group, acyl group, alkoxycarbonyl group or aryloxycarbonyl group. The arylsulfonyloxy group is further preferable.

The substituents described above may bond to the benzene ring at any one of ortho-, metha- and para-positions, preferably at the ortho- or para-position, and more preferably at the ortho position with respect to the carboxyl group.

The halogen atom and alkyl group are preferable as the substituents of $R^1$, $R^2$, $R^3$, $R^4$ and $R^5$ other than those described above, and the chlorine atom and methyl group are particularly preferable in General formula (2).

The aromatic carboxylic acid compound represented by General formula (2) can be readily synthesized by the methods known in the art.

Although the aromatic carboxylic acid compound represented by General formula (2) may be added to the layer at the side of the photosensitive layer (imaging layer) of the support, or may be added to the photosensitive layer or to any other layers at the side of the photosensitive layer, it is preferable to add it to the photosensitive layer or to the layer adjoining the photosensitive layer.

Similar to the reducing agent, the aromatic carboxylic acid compound represented by General formula (2) may be added to the heat developable photosensitive material in any form including a solution, an emulsion and a solid. The amount of the compound represented by General formula (2) is preferably 0.1 to 100 mol %, more preferably 0.5 to 50 mol %, and further preferably 1 to 30 mol % relative to the total amount of the reducing agent.

Examples of the aromatic carboxylic acid compound (examples 2-1 to 2-27) represented by General formula (2) are shown below, the compounds to be used in the invention are not restricted thereto.

2-1

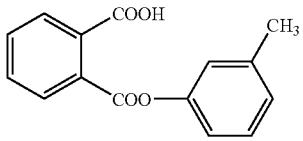

2-2

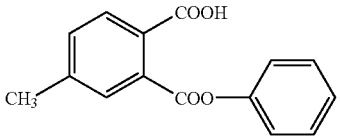

2-3

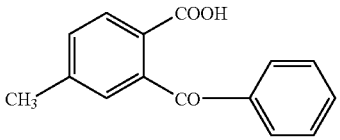

2-4

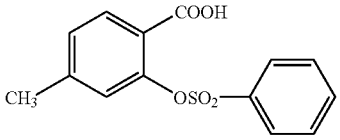

2-5

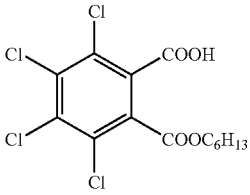

2-6

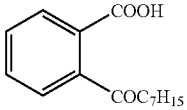

2-7

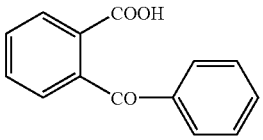

2-8

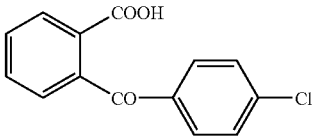

-continued 2-9

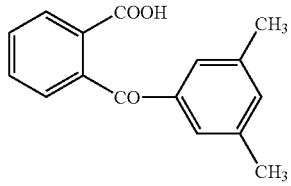

2-10

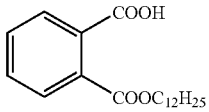

2-11

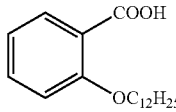

2-12

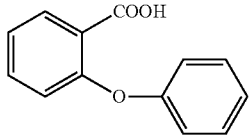

2-13

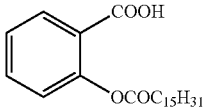

2-14

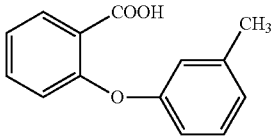

2-15

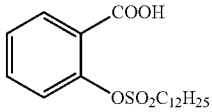

2-16

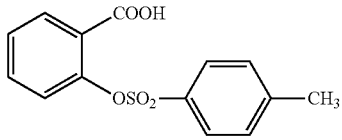

2-17

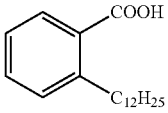

2-18

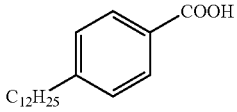

2-19

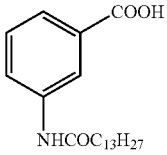

-continued 2-20

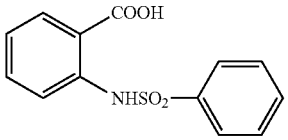

2-21

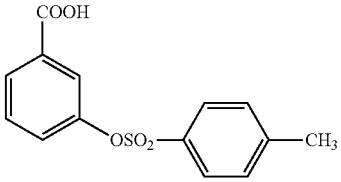

2-22

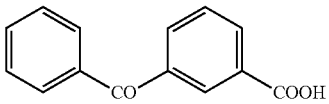

2-23

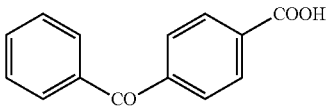

2-24

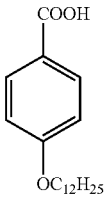

2-25

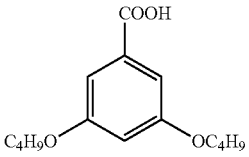

2-26

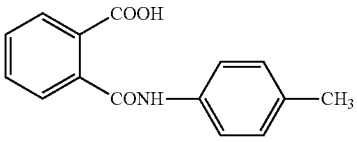

2-27

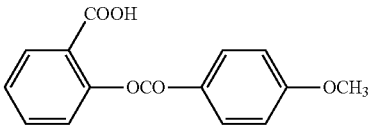

The heat developable photosensitive material of the invention contains a non-photosensitive organic silver salt (simply referred to as an organic silver salt hereinafter). The organic silver salt used in the invention is relatively stable with respect to light and forms a silver image when heated at 80° C. or more in the presence of an exposed photocatalyst (a latent image of a photosensitive silver halide) and a reducing agent.

While any organic substances containing a source which can reduce silver ions may be used as the organic silver salt in the heat developable photosensitive material of the invention, the content of silver behenate is 53 to 85 mol %, preferably 58 to 80 mol %, and particularly preferably 63 to 75 mol % in the invention. Other preferable silver salts of organic acids include silver salts of long chain aliphatic carboxylic acids having 10 to 30, and preferably 15 to 28 carbon atoms. Complexes of organic or inorganic silver salts with a complex stability constant of the ligand being 4.0 to 10.0 are also preferable. These non-photosensitive silver salts of organic acids are disclosed in the paragraph numbers 0048 to 0049 in Japanese Patent Application Laid-Open (JP-A) No. 10-62899, p. 18, line 24 to p. 19, line 37 in EP Nos. 0,803,764A1 and 0,962,812A1, JP-A Nos. 11-349591, 2000-7683 and 2000-72711. Preferable organic silver salts contain silver salts of organic compounds having carboxylic groups. These examples contain silver salts of aliphatic carboxylic acids and aromatic carboxylic acids, but they are not restricted thereto. Preferable examples of the silver salts of the aliphatic fatty acids include silver salts of arachidic acid, stearic acid, oleic acid, lauric acid, caproic acid, myristic acid, palmitic avid, maleic acid, fumaric acid, tartaric acid, linolic acid, butyric acid and camphoric acid, and mixtures thereof, in addition to silver behenate. The silver salt of the organic acid as a silver donor preferably accounts for about 5 to 30% by mass of the photosensitive layer (imaging layer).

The shape of the organic silver salts used in the invention is not particularly restricted, and may be cubic, rectangular parallelepiped, rod-like, needle-like, tabular and scale-like shapes. However, the cubic, rectangular parallelepiped, rod-like and needle-like shapes are relatively preferable. The cubic, rectangular parallelepiped, rod-like and needle-like silver salts of the organic acids are defined as follows. The salts of the organic acids are observed under an electron microscope, and the shape of the organic silver salt particles are approximated as rectangular parallelepiped. Then, the edges of the rectangular parallelepiped particle are named as a, b and c, respectively, in the order of smallness of the length ($a \leqq b \leqq c$). The cubic particles are defined as the particles having an a/c ratio or of 0.9 to 1.0. The rectangular parallelepiped particles are defined as particles having an a/c ratio of 0.2 to less than 0.9 and a b/c ratio of 0.2 to less than 1.0. The rod-like particles are defined as particles having an a/c ratio of 0.1 to less than 0.2 and a b/c ratio of 0.1 to less than 0.3. The needle-like particles are defined as particles having an a/c ratio of less than 0.1 and a b/c ratio of less than 0.1. The silver salt of the organic acid of the invention is preferably the needle-like and rod-like particles, and the needle-like particles are most preferable.

It is well known in the art of the silver halide photographic photosensitive material that the size of the crystal grains of the silver salt is inversely proportional to the coating power of the grains. This relation is also valid in the heat developable photosensitive material of the invention, and means that the coating power is reduced, and the image density decreases, when the particle size of the organic silver salt particles as the imaging component of the heat developable photosensitive material is large. Accordingly, it is preferable to reduce the particle size of the organic silver salt. In the invention, a minor axis is preferably 0.01 μm to 0.20 μm, and a major axis is preferably 0.10 μm to 5.0 μm, and a minor axis is more preferably 0.01 μm to 0.15 μm, and a major axis is more preferably 0.10 μm to 4.0 μm.

It is preferable that the particle size distribution of the organic silver salt is monodisperse. Monodisperse means that the percentage of the values obtained by dividing the standard deviations of the lengths of the minor and major axes by the lengths of the minor and major axes, respectively, are preferably 100% or less, more preferably 80% or less, and further preferably 50% or less. The shape of the organic silver salt can be measured by observing the dispersion of the organic silver salt under a transmission electron microscope. The monodisperse feature may be alternatively obtained from the standard deviation of the volume average particle diameter of the organic silver salt, and the percentage (the variation coefficient) obtained by dividing the standard deviation of the volume average diameter by the volume average diameter is preferably 100% or less, more preferably 80% or less, and more preferably 50% or less. In an example of the measuring method, the organic silver salt dispersed in a solvent is irradiated with a laser beam, and an autocorrelation function between fluctuation of the scattered light and change thereof with time is determined to determine the particle size (volume average particle diameter).

The organic silver salt used in the invention is granulated in an aqueous solvent and dried, and the granules are dispersed in a solvent such as MEK. The granules are dried preferably under an oxygen partial pressure of 0.01 to 15 vol %, more preferably 0.01 to 10 vol %, using an air flow type flush jet dryer.

While a desired amount of the organic silver salt may be used, the total amount of the applied silver including the amount of applied photosensitive silver halide is preferably 0.1 to 1.9 g/m$^2$, more preferably 0.5 to 1.8 g/m$^2$, and further preferably 1.0 to 1.7 g/m$^2$.

The heat developable photosensitive material contains photosensitive silver halide (simply referred as silver halide hereinafter).

The method for forming photosensitive silver halide to be used in the invention is well known in the art, and is disclosed, for example, in Research Disclosure No. 17029, June 1978, and in U.S. Pat. No. 3,700,458. Examples of the methods to be used in the invention include a method in which a part of silver in the organic silver salt is converted into photosensitive silver halide by adding a halogen-containing compound into the prepared organic silver salt, and a method in which the photosensitive silver halide particles are prepared by adding a silver donor compound and halogen donor compound into a solution of gelatin or other polymers, followed by mixing it with the organic silver salt. The latter method may be preferably used in the invention. A smaller particle size of photosensitive silver halide is preferable in order to suppress images from being muddy, and the size is preferably 0.0001 to 0.15 μm, more preferably 0.02 to 0.10 μm. Sensitivity may be insufficient when the particle size of silver halide is too small, while haze of the photosensitive material may increase when the particle size is too large.

The particle size as used herein corresponds to the length of the edge of the silver halide particles when they have a so-called normal crystal with a cubic or octahedral crystal form. When the silver halide particles are tabular particles, the diameter corresponds to a diameter of a circular image having the same area as the projected area of the principal surface of the particle. When the silver halide crystal takes a configuration other than the normal crystal, such as spherical or rod-like shape, the diameter corresponds to that having an equal volume to the silver halide particle.

The shape of the silver halide particles include cubic, octahedral, tabular, spherical, rod-like and potato-like shapes, and the cubic or tabular particles are preferable in the invention. The average aspect ratio of the tabular silver halide particles is preferably 100:1 to 2:1, and more preferably 50:1 to 3:1. The silver halide particles having round corners may be also preferably used. While no restrictions are imposed on the surface indices (Miller indices) of the external surface of the photosensitive silver halide particles, it is preferable that the proportion of the [100] faces whose spectral sensitivity efficiency is high when a spectral sensitizing dye is adsorbed thereto. The proportion is preferably 50% or more, more preferably 65% or more, and further preferably 80% or more. The proportion of the face having the [100] Miller indices can be determined by the method described by T. Tani (J. Imaging Sci., 29, 165, 1985) which takes advantage of absorption dependency of the [111] and [100] faces in adsorbing the sensitizing dye.

The composition of halogen in the photosensitive silver halide is not particularly restricted, and any one of silver chloride, silver chlorobromide, silver bromide, silver iodobromide, silver iodochlorobromide and silver iodide may be used. However, silver bromide or silver iodobromide is preferably used in the invention. Silver iodobromide is most preferable, and the content of silver iodide is preferably 0.1 to 40 mol %, and more preferably 0.1 to 20 mol %. While halogen may be uniformly distributed in the particle, or the halogen composition may be gradually or continuously changed, the silver iodobromide particles having a high silver iodide content in the inside of particles may be preferably used. The silver halide particles having a core/shell structure may be also preferably used. The particles preferably have two to five fold core/shell structures, and more preferably two to four fold core/shell structures.

It is preferable that the photosensitive silver halide particle to be used in the invention contains at least one of complexes of metals selected from rhodium, rhenium, ruthenium, osmium, iridium, cobalt, mercury or iron. One kind of these metal complexes may be used, or two or more kinds of the complexes of the same metal or different metals may be used together. The content is preferably 1 mmol to 10 mmol, and more preferably 10 mmol to 100 μmol, relative to 1 mole of silver. Examples of the structure of the metal complexes used are disclosed in JP-A No. 7-225449. Preferably used cobalt and iron compounds are hexacyano metal complexes including, for example, ferricyanate ion, ferrocyanate ion and hexacyano cobalt ion. However, the metal complexes are not restricted thereto. Distribution of the metal complex phase is not particularly restricted, and the metal complex may be uniformly distributed in silver halide, or may be incorporated in higher concentration in the core portion, or may be incorporated in higher concentration into the shell part.

The photosensitive silver halide particles may be desalted by a washing method known in the art such as a noodle method and flocculation method known in the art, but desalting is not required in the invention.

The photosensitive silver halide used in the invention is preferably subjected to chemical sensitization. Preferable chemical sensitization methods include a sulfur sensitization method, selenium sensitization method and tellurium sensitization method known in the art. Precious metal sensitization methods using a gold, platinum, palladium or iridium compound, or a reduction sensitization method may be alternatively used. The compounds known in the art may be preferably used for the sulfur sensitization, selenium sensitization and tellurium sensitization methods, and these compounds are described in JP-A No. 7-128768.

The amount of the photosensitive silver halide in the invention is preferably 0.01 to 0.5 mole, more preferably 0.02 to 0.3 mole, and particularly preferably 0.03 to 0.25 mole relative to one mole of the organic silver salt. As for the mixing method and mixing condition of the independently prepared silver halide particles and organic silver salt, they are mixed with a high speed stirrer, ball mill, sand mill, colloid mill, vibration mill or homogenizer, or the previously prepared photosensitive silver halide is mixed with the system at any timing of preparation of the organic silver salt. However, the method is not particularly restricted so long as the effect of the invention is sufficiently manifested.

A so-called halidation method is also preferably used as the method for preparing the silver halide used in the invention, in which method a part of silver of the organic silver salt is halogenated with an organic or inorganic halide. Any organic halide may be used herein so long as it forms silver halide by reacting with the organic silver salt, and examples of the organic halide include N-halogenoimide (such as N-bromosuccimide), halogenated quaternary nitrogen-containing compounds (such as tetrabutylammonium bromide) and an association of halogenated quaternary nitrogen-containing salt and halogen molecules (such as perbromopyridinium). Any inorganic halogen compounds that form silver halide by reacting with the organic silver salt may be used, and examples thereof include halogenated alkali metals and ammonium (such as sodium chloride, lithium bromide, potassium iodide and ammonium bromide), halogenated alkali earth metals (such as calcium bromide and magnesium bromide), halogenated transition metals (such as ferric chloride and cupric bromide), metal complexes having a halogen ligand (such as sodium bromoiridate, ammonium chlororhodate) and halogen molecules (such as bromine, chlorine and iodine molecules). Desirable organic or inorganic halides may be used together. The amount of the halide for halidation is preferably 1 to 500 mmol, and more preferably 10 to 250 mmol, relative to 1 mole of the organic silver salt.

The sensitizing dye to be employed in the invention can spectrally sensitize the silver halide particles in a desired wavelength region when adsorbed on the silver halide particles, and it is advantageous to select the sensitizing dye having a spectral sensitivity suitable for spectral characteristics of the exposure light source. The sensitizing dyes and methods of addition include the compounds in paragraph Nos. 0103 to 0109 of JP-A No. 11-65021; the compounds represented by the General formula (II) in JP-A No. 10-186572; the dyes represented by the general formula (I) in JP-A No. 11-119374; dyes described in the paragraph No. 0106 of U.S. Pat. No. 5,510,236 and in U.S. Pat. Nos. 5,510,236, and 5,541,054 and in example 5 of U.S. Pat. No. 3,871,887; dyes disclosed in JP-A Nos. 2-96131 and 59-48753; and dyes and methods described in p. 19, line 38 to p. 20, line 35 of EP 0,803,764A1, Japanese Patent Application Nos. 2000-86865 and 2000-102560, and JP-A Nos. 2000-95958, 2000-171938, 2000-227642, 2000-250166, 2000-258870, 2001-83655 and 9-166844.

These sensitizing dyes may be used alone, or as a combination of at least two of them. A desired amount of the sensitizing dye may be used depending on sensitivity and fogging prevention performance, and the amount of addition is preferably $10^{-6}$ to one mole, and more preferably $10^{-4}$ to $10^{-1}$ mole per one mole of silver halide in the photosensitive layer. A combination of the sensitizing dyes is frequently used for the purpose of super-sensitization. A dye that has no spectral sensitization action by itself, or a substance that does not substantially absorb visible light but exhibits a super-sensitization effect, may be incorporated in the emulsion together with the sensitizing dye. Useful sensitizing dyes, combinations of dyes exhibiting a super-sensitization effect, and substances that manifest a super-sensitization effect are described in section IV-J, p 23, Research Disclosure 17643, Vol. 176 (published in December, 1978), or in JP-B Nos. 49-25500 and 43-4933, and JP-A Nos. 59-19032 and 59-192242.

Development accelerators that may be incorporated in the heat developable photosensitive material of the invention will be described hereinafter. Any compounds that can accelerate heat development, or reducing agents, may be used as the development accelerator.

The development accelerator is a compound that reduces the light exposure required for obtaining a black density of 1.0, to 90% or less of that when no accelerator is added, by adding 10 mol % of the compound relative to the principal reducing agent. The compound is preferably added in a proportion of 5 mol %, more preferably 2 mol %, relative to the principal reducing agent, thereby reducing the light exposure required for obtaining the black density of 1.0, to 90% or less of that when no development accelerator is added.

Examples of the development accelerator that is preferably added include carbamoylhydrazine compounds described in Japanese Patent Application No. 2001-11583, sulfone acid phenol compounds described in JP-A No. 2000-267222, phenolic compounds described in Japanese Patent Application No. 2001-96643, or the naphthol compounds represented by General formula (3):

General formula (3)

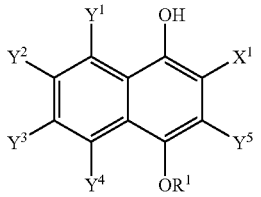

In General formula (3), $R^1$ represents an alkyl group, aryl group, alkenyl group and alkynyl group. The alkyl group represented by $R^1$ is a straight, branched or cyclic alkyl group, preferably having 1 to 30 carbon atoms, more preferably having 1 to 16 carbon atoms, and further preferably having 1 to 13 carbon atoms, or a combination thereof. Examples of $R^1$ include methyl group, ethyl group, n-propyl group, isopropyl group, n-butyl group, sec-butyl group, t-butyl group, n-hexyl group, cyclohexyl group, n-octyl group, t-octyl group, n-amyl group, t-amyl group, n-decyl group, n-dodecyl group, n-tridecyl group, benzyl group and phenethyl group.

The aryl group represented by $R^1$ has preferably 6 to 30, and more preferably 6 to 20, and further preferably 6 to 12 carbon atoms. Examples of the aryl group include phenyl group, 4-methylphenyl group, 2-chlorophenyl group, 4-chlorophenyl group, 2,4-dichlorophenyl group, 3,4-dichlorophenyl group, 2-methoxyphenyl group, 4-methoxyphenyl group, 4-hexyloxyphenyl group, 2-dodecyloxyphenyl group and naphthyl group.

The alkenyl group represented by $R^1$ has preferably 2 to 30, more preferably 2 to 20, and further preferably 2 to 12 carbon atoms. Examples of the alkenyl group include vinyl group, allyl group, isopropenyl group, butenyl group and cyclohexenyl group.

The alkynyl group represented by $R^1$ has preferably 2 to 30, more preferably 2 to 20, and further preferably 2 to 12 carbon atoms. Examples of the alkynyl group include ethynyl group and propynyl group.

$R^1$ in General formula (3) may be further substituted, and examples of the preferable substitute include groups represented by $Y^1$ to $Y^5$ in the compound represented by General formula (3) to be described hereinafter.

More preferably, $R^1$ in General formula (3) represents an alkyl group or aryl group, particularly preferably an alkyl group.

$X^1$ in General formula (3) represents an acyl group, an alkoxycarbonyl group, a carbamoyl group, a sulfonyl group or a sulfamoyl group.

The acyl group represented by $X^1$ has preferably 2 to 20, more preferably 2 to 16, and particularly preferably 2 to 12 carbon atoms. Examples of the acyl group include acetyl group, propionyl group, butyryl group, valeryl group, hexanoyl group, myristyl group, palmitoyl group, stearyl group, oleyl group, acryloyl group, cyclohexanecarbonyl group, benzoyl group, formyl group and pyvaloyl group.

The alkoxycarbonyl group represented by $X^1$ has preferably 2 to 20, more preferably 2 to 16, and particularly preferably 2 to 12 carbon atoms. Examples of the alkoxycarbonyl group include methoxycarbonyl group, ethoxycarbonyl group, butoxycarbonyl group and phenoxycarbonyl group.

The carbamoyl group represented by $X^1$ has preferably 1 to 20, more preferably 1 to 16, and particularly preferably 1 to 12 carbon atoms. Examples of the carbamoyl group include carbamoyl group, N,N-diethylcarbamoyl group, N-dodecylcarbamoyl group, N-decylcarbamoyl group, N-hexadecylcarbamoyl group, N-phenylcarbamoyl group, N-(2-chlorophenyl)carbamoyl group, N-(4-chlorophenyl) carbamoyl group, N-(2,4-dichlorophenyl)carbamoyl group, N-(3,4-dichlorophenyl)carbamoyl group, N-pentachlorophenylcarbamoyl group, N-(2-methoxyphenyl)carbamoyl group, N-(4-methoxyphenyl)carbamoyl group, N-(2,4-dimethoxyphenyl) carbamoyl group, N-(2-dodecyloxyphenyl)carbamoyl group and N-(4-dodecyloxyphenyl)carbamoyl group.

The sulfonyl group represented by $X^1$ has preferably 1 to 20, more preferably 1 to 16, and particularly preferably 1 to 12 carbon atoms. Examples of the sulfonyl group include mesyl group, ethanesulfonyl group, cyclohexanesulfonyl group, benzenesulfonyl group, tosyl group and 4-chlorobenzenesulfonyl group.

The sulfamoyl group represented by $X^1$ has preferably 0 to 20, more preferably 0 to 16, and particularly preferably 0 to 12 carbon atoms. Examples of the sulfamoyl group include sulfamoyl group, methylsulfamoyl group, dimethylsulfamoyl group and phenylsulfamoyl group.

In General formula (3), $X^1$ preferably represents a carbamoyl group, more preferably alkylcarbamoyl group or arylcarbamoyl group, and particularly preferably arylcarbamoyl group.

In General formula (3), each of $Y^1$ to $Y^5$ independently represents a hydrogen atom or a substituent. Any substituents may be used as the substituents represented by $Y^1$ to $Y^5$ so long as they do not adversely affect photographic properties. Examples thereof include halogen atom (e.g., fluorine atom, chlorine atom, bromine atom and iodine atom), straight, branched, or cyclic alkyl group (preferably having 1 to 20, more preferably 1 to 16 and particularly preferably 1 to 13 carbon atoms; examples thereof include methyl group, ethyl group, n-propyl group, isopropyl group, sec-butyl group, t-butyl group, t-octyl group, n-amyl group, t-amyl group, n-dodecyl group and n-tridecyl group, cyclohexyl group) or a combination thereof, alkenyl group (preferably having 2 to 20, more preferably 2 to 16 and particularly preferably 2 to 12 carbon atoms; examples thereof include vinyl group, allyl group, 2-butenyl group and 3-pentenyl group), aryl group (preferably having 6 to 30, more preferably 6 to 20 and particularly preferably 6 to 12 carbon atoms; examples thereof include phenyl group, p-methylphenyl group and naphthyl group), alkoxy group (preferably having 1 to 20, more preferably 1 to 16 and particularly preferably 1 to 12 carbon atoms; examples thereof include methoxy group, ethoxy group, propoxy group and butoxy group), aryloxy group (preferably having 6 to 30, more preferably 6 to 20 and particularly preferably 6 to 12 carbon atoms; examples thereof include phenyloxy group and 2-naphthyloxy group), acyloxy group (preferably having 2 to 20, more preferably 2 to 16 and particularly preferably 2 to 12 carbon atoms; examples thereof include acetoxy group and benzoyloxy group), amino group (preferably having 0 to 20, more preferably 1 to 16 and particularly preferably 1 to 12 carbon atoms; examples thereof include dimethylamino group, diethylamino group, dibutylamino group and anilino group), acylamino group (preferably having 2 to 20, more preferably 2 to 16 and particularly preferably 2 to 13 carbon atoms; examples thereof include acetylamino group, tridecanoylamino group and benzoylamino group), sulfonylamino group (preferably having 1 to 20, more preferably 1 to 16 and particularly preferably 1 to 12 carbon atoms; examples thereof include methanesulfonylamino group, butanesulfonylamino group and benzenesulfonylamino group), ureido group (preferably having 1 to 20, more preferably 1 to 16 and particularly preferably 1 to 12 carbon atoms; examples thereof include ureido group, methylureido group and phenylureido group), carbamate group (preferably having 2 to 20, more preferably 2 to 16 and particularly preferably 2 to 12 carbon atoms; examples thereof include methoxycarbonylamino group and phenyloxycarbonylamino group), carboxyl group, carbamoyl group (preferably having 1 to 20, more preferably 1 to 16 and particularly preferably 1 to 12 carbon atoms; examples thereof include carbamoyl group, N,N-diethylcarbamoyl group, N-dodecylcarbamoyl group and N-phenylcarbamoyl group), alkoxycarbonyl group (preferably having 2 to 20, more preferably 2 to 16 and particularly preferably 2 to 12 carbon atoms; examples thereof include methoxycarbonyl group, ethoxycarbonyl group and butoxycarbonyl group), acyl group (preferably having 2 to 20, more preferably 2 to 16 and particularly preferably 2 to 12 carbon atoms; examples thereof include acetyl group, benzoyl group, formyl group and pyvaloyl group), sulfo group, sulfonyl group (preferably having 1 to 20, more preferably 1 to 16 and particularly preferably 1 to 12 carbon atoms; examples thereof include mesyl group and tosyl group), sulfamoyl group (preferably having 0 to 20, more preferably 0 to 16 and particularly preferably 0 to 12 carbon atoms; examples thereof include sulfamoyl group, methylsulfamoyl group and dimethylsulfamoyl group, phenylsulfamoyl group), cyano group, nitro group, hydroxyl group, mercapto group, alkylthio group (preferably having 1 to 20, more preferably 1 to 16 and particularly preferably 1 to 12 carbon atoms; examples thereof include methylthio group and butylthio group), and heterocyclic group (preferably having 2 to 20, more preferably 2 to 16 and particularly preferably 2 to 12 carbon atoms; examples thereof include pyridyl group, imidazoyl group and pyrrolidyl group). These groups may be further substituted with other groups.

Preferable substituents represented by $Y^1$ to $Y^5$ in General formula (3) include, among those described above, halogen atom, alkyl group, aryl group, alkoxy group, aryloxy group, acyloxy group, anilino group, acylamino group, sulfonylamino group, carboxyl group, carbamoyl group, acyl group, sulfo group, sulfonyl group, sulfamoyl group, cyano group, hydroxyl group, mercapto group, alkylthio group and heterocyclic group.

A combination in which $R^1$ is an alkyl group, $X^1$ is a carbamoyl group and $Y^1$ to $Y^1$ are hydrogen atoms is preferable in the General formula (3).

A color control agent is preferably added to the heat developable photosensitive material of the invention. The color control agent is described in the paragraph Nos. 0054 to 0055 in JP-A No. 10-62899, in lines 23 to 48, p 21 in EP No. 0803764A1, and Japanese Patent Application No. 10-213487. A combination of phthaladinone (phthaladinone, phthaladinone derivatives or metal salts thereof; for example 4-(1-naphthyl)phthaladinone, 6-chloro-phthaladinone, 5,7-dimethoxyphthaladinone and 2,3-dihydro-1,4-phthaladinedione); a combination of phthaladinone and phthalic acid (for example phthalic acid, 4-methylphthalic acid, 4-nitrophthalic acid and tetrachlorophthalic anhydride), phthaladine (phthaladine, phthaladine derivatives or metal salts thereof; for example 4-(1-naphthyl)phthaladine, 6-isopropylphthaladine, 6-t-butylphthaladine, 6-chlorophthaladine, 5,7-deimethoxyphthaladine and 2,3-dihydrophthaladine); and a combination of phthaladine and phthalic acid are preferable. The combination of phthaladine and phthalic acid is particularly preferable. The color control agent is preferably added in a proportion of 0.1 to 50 mol %, and more preferably in a proportion of 0.5 to 20 mol %, relative to 1 mole of silver on the surface containing the imaging layer.

The heat developable photosensitive material according to the invention contains a binder.

Any one of natural or synthetic resins may be used as the binder in the photosensitive layer of the heat developable photosensitive material according to the invention, and examples of the resins include gelatin, polyvinyl butyral, polyvinyl acetal, polyvinyl chloride, polyvinyl acetate, cellulose acetate, polyolefine, polyester, polystyrene, polyacrylonitrile, polycarbonate, butylethyl cellulose, methacrylate copolymer, maleic anhydride-ester copolymer, and butadiene-styrene copolymer. Polyvinyl butyral is preferably used as the binder in a proportion of 50% by weight or more relative to the total amount of the binder(s). A copolymer and terpolymer is naturally included in the resins. The total amount of polyvinyl butyral is preferably 50 to 100% by weight, and more preferably 70 to 100% by weight, relative to the total amount of the binder(s).

The Tg value of the binder contained in the photosensitive layer is preferably 40 to 90° C., and more preferably 50 to 80° C. Tg as used herein means a glass transition temperature.

The total amount of the binder in the photosensitive layer in the invention should be enough to maintain the components in the layer. In other words, the binder is used in a range that effectively functions as the binder. The effective range may be properly determined by those skilled in the art. The proportion of the binder and organic silver salt is in the range of 15:1 to 1:3, and particularly preferably 8:1 to 1:2, in mass ratio as a measure for retaining the organic silver salt.

A fog preventing agent, stabilizer and precursor of the stabilizer protect the silver halide emulsion and/or organic silver salt from generation of additional fog, preventing sensitivity of the photosensitive material from decreasing during storage. Appropriate fog preventing agents, stabilizers and precursors of the stabilizer that can be used alone or as a combination include thiazonium salts described in U.S. Pat. Nos. 2,131,038 and 2,694,716; azaindene described in U.S. Pat. Nos. 2,886,437 and 2,444,605; compounds described in JP-A No. 9-329865 and U.S. Pat. No. 6,083,681; mercury salts described in U.S. Pat. No. 2,728,663; urazole described in U.S. Pat. No. 3,287,135; sulfocatechol described in U.S. Pat. No. 3,235,652; oxime, nitron and nitroindazole described in U.K. Patent No. 623,448; multivalent metal salts described in U.S. Pat. No. 2,839,405; thiuronium salts described in U.S. Pat. No. 3,220,839; palladium, platinum and god salts described in U.S. Pat. Nos. 2,566,263 and 2,597,915; halogen-substituted organic compounds described in U.S. Pat. Nos. 4,108,665 and 4,442,202; triazine described in U.S. Pat. Nos. 4,128,557, 4,137,079, 4,138,365 and 4,459,350; and phosphor compounds described in U.S. Pat. No. 4,411,985.

The fog preventing agent preferably used in the invention contains organic halides, and polyhalomethyl compounds, particularly preferably trihalomethyl sulfone compounds are preferable among them. The organic halides are described, for example, in JP-A Nos. 50-119624, 50-120328, 51-121332, 54-58022, 56-70543, 56-99335, 59-90842, 61-129642, 62-129845, 6-208191, 6-5621, 6-2781, 8-15809, 9-160167, 9-244177, 9-244178, 9-258367, 9-265150, 9-319022, 10-171063, 11-212211, 11-231460, 11-242304, U.S. Pat. Nos. 5,340,712, 5,369,000 and 5,464,737. Examples thereof include 2-(tribromomethyl-sulfonyl) quinoline, 2-(tribromomethylsulfonyl)pyridine, tribromomethylphenyl sulfone and tribromomethylnaphthyl sulfone.

Mercury (II) salts may be advantageously added to the photosensitive layer as a fog preventing agent, although it is not always necessary for the invention. The mercury (II) salts preferable for this purpose are mercury acetate and mercury bromide. The amount of mercury to be used in the invention is preferably 1 mmol to 1 mmol, and more preferably 10 mmol to 100 μmol, relative to 1 mole of applied silver.

Mercapto compounds, disulfide compounds and thionic compounds may be contained in the invention in order to control development by suppressing or accelerating development, improve spectral sensitization efficiency, and improve preservative property before and after development.

While any structures of the mercapto compounds may be accepted for use in the invention, the compounds represented by Ar—SM and AR—S—S—Ar are preferable. M denotes a hydrogen atom or an alkali metal atom, and Ar denotes an aromatic or a condensed aromatic ring containing at least one nitrogen, sulfur, oxygen, selenium or tellurium atom.

Preferably, examples of the heterocyclic aromatic ring include benzimidazole, naphthimidzole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline or quinazolinone. The heterocyclic aromatic ring may contain a substituent selected from a group containing, for example, halogen (for example Br and Cl), hydroxyl group, amino group, carboxyl group, alkyl group (for example having at least one carbon atom, preferably 1 to 4 carbon atoms), and alkoxy group ((for example having at least one carbon atom, preferably 1 to 4 carbon atoms). Examples of the heterocyclic aromatic compounds substituted with a mercapto group include, but are not limited to, 2-mrcaptoimidazole, 2-mercaptobenzoxazole, 2-mercaptobenzothiazole, 2-mercapto-5-methylbenzimidazole, 6-ethoxy-2-mercaptobenzothiazole, 2,2'-dithiobis-(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyridine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole and 2-mercapto-4-phenyloxazole.

The amount of these mercapto compounds is preferably 0.001 to 1.0 mole per one mole of silver in the photosensitive layer, and more preferably 0.01 to 0.3 mole per one mole of silver.

A plasticizer and lubricant to be used in the photosensitive layer in the invention are described in paragraph No. 0117 in JP-A No. 11-65021; ultra high contrasting agents for forming super-contrasty images, methods for adding the same and the amount thereof are described in paragraph No. 0118 in JP-A Nos. 11-65021, paragraph Nos. 0136 to 0193 in JP-A No. 11-223898, compounds in the formulae (H), (1) to (3), and (A) and (B) in Japanese Patent Application No. 11-87297, and compounds in general formulae (III) to (V) and the concrete compounds thereof described in Japanese Patent Application No. 11-91652. Contrasting accelerators are described in the paragraph No. 0102 in JP-A No. 11-65021 and paragraph Nos. 0194 to 0195 in JP-A 11-223898.

The layer containing the photosensitive silver halide particles of the invention preferably has absorbance of 0.1 to 0.6, and more preferably 0.2 to 0.5 in the wavelength of the exposed light. $D_{min}$ increases and the image becomes difficult to distinguish when the absorbance is too large, while sharpness of the image is deteriorated when the absorbance is too small. Although any method may be employed to allow the photosensitive silver halide layer to have an appropriate absorbance, dyes are preferably used. Any dyes may be used so long as they satisfy the absorbance conditions described above, and examples thereof include a pyrazoloazol dye, anthraquinone dye, azo dye, azomethine dye, oxonol dye, carbocyanine dye, styryl dye, triphenylmethane dye, indoaniline dye, indophenol dye and squalirium dye. The preferable dyes to be used in the invention include anthraquinone dyes (e.g., compounds 1 to 9 described in JP-A No. 5-341441; and 3-6 to 18 and 3-23 to 3-38 described in JP-A No. 5-165147), azomethine dyes (compounds 17 to 47 in JP-A No. 5-341441), indoaniline dyes (e.g., compounds 11 to 19 in JP-A No. 5-289227, compound 47 described in JP-A No. 5-341441; and compounds 2-10 to 2-11 in JP-A No. 5-165147) azo dyes (compounds 10 to 16 described in JP-A No. 5-341441) and squalirium dyes (compounds 1 to 20 described in JP-A No. 10-104779; and compounds 1a to 3d described in U.S. Pat. No. 5,380,635).

These dyes may be added as a solution, emulsion or dispersed fine solid particles, or may be used with a polymer mordant. The amount of these compounds is determined depending on the desired amount of absorption, and it is preferably used in the range of 1 μg to 1 g per 1 $m^2$.

Any layers other than the layer containing the photosensitive silver halide particles has an absorbance of 0.1 to 3.0 at the wavelength of the exposure light in the invention. An absorbance of 0.3 to 2.0 is more preferable in view of halation prevention. The layer that absorbs the exposed light at that wavelength is preferably the layer (a back layer, an undercoat layer or an underlayer of the backed surface, or a protective layer of the back layer) which is provided on one surface of a support, on the other surface of which the layer containing the photosensitive silver halide particles is formed, or an interlayer (undercoat layer or underlayer) between the layer containing the photosensitive silver halide particles and support.

When the photosensitive silver halide particles are spectrally sensitized in the infrared region, any method may be used as a method for making the layers other than the layer containing the photosensitive silver halide particles to absorb the light. However, the layers preferably have a maximum absorbance of 0.3 or less in the visible region. The same dye as the dye used for permitting the photosensitive silver halide layer to absorb light may be used as the coloring dye, and the dye may be the same as or different from the dye used in the photosensitive silver halide layer.

Although any method for allowing the layers other than the layer containing the photosensitive silver halide particles to absorb light when the photosensitive silver halide particles are spectrally sensitized in the visible region may be employed, a dye that is decolorized by heat treatment, or a combination of a compound that decolorizes a dye by heating and the dye that is decolorized by heating may be preferably used. Examples of decolorizable colored layer include the following compounds, but the invention is not restricted thereto. These compounds are provided in the art disclosed in JP-A Nos. 52-139136, 53-132334, 56-501480, 57-16060, 57-68831, 57-101835, 59-182436, 7-36145 and 7-199409; JP-B Nos. 48-33692, 50-16648 and 2-41734; and U.S. Pat. Nos. 4,088,497, 4,283,487, 4,548,896 and 5,187,049. The amount of these compounds is determined by the desired amount of absorption, and it is preferably of 1 μg to 1 g per 1 $m^2$.

The photosensitive material of the invention may have a surface protective layer for the purpose of prevention of adhesion of foreign matters to the photosensitive layer (imaging layer). Any polymers may be used as the binder for the surface protective layer. Examples of the binder include polyester, gelatin, polyvinyl alcohol and cellulose derivatives, and the cellulose derivative is preferable. Examples of the cellulose derivatives include, but are not limited to, cellulose acetate, cellulose acetate butylate, cellulose propionate, hydroxypropyl cellulose, hydroxypropylmethyl cellulose, methyl cellulose, hydroxyethyl cellulose and carboxymethyl cellulose, and mixtures thereof.

The thickness of the surface protective layer in the invention is preferably 0.1 to 10 μm, and more preferably 1 to 5 μm.

The surface protective layer may include any adhesion preventing material. Examples of the adhesion preventing layer include wax, liquid paraffin, silica particles, elastomer of block copolymer containing styrene (e.g., styrene-butadiene-styrene and styrene-isoprene-styrene copolymers), cellulose acetate, cellulose acetate butyrate and cellulose propionate, and mixtures thereof.

Photographic elements that contain light absorbing substances and filter dyes as described in U.S. Pat. Nos. 3,253,921, 2,274,782, 2,527,583 and 2,956,879 may be used in the photosensitive layer or in the protective layer. For example, dyes as described in U.S. Pat. No. 3,282,699 may be used as mordants. The amount of the filter dye preferably is such that an absorbance is 0.1 to 3, and more preferably 0.2 to 1.5 at the wavelength of the exposure light.

A flatting agent such as starch, titanium dioxide, zinc oxide, silica and polymer beads containing the beads as described in U.S. Pat. Nos. 2,992,101 and 2,701,245 may be incorporated into the photosensitive layer or into the protective layer. Although any degree of matting may be accepted so far as no star dust fault occurs, Beck smoothness is preferably 200 to 10,000 seconds, and more preferably 300 to 10,000 seconds.

The photosensitive layer contains one or more layers on the support. When the photosensitive layer contains one layer, it is composed of a non-photosensitive organic silver salt, photosensitive silver halide, reducing agent and binder and, if necessary, auxiliary materials such as a color control agent, coating assistant and other auxiliary chemicals. When the photosensitive layer contains two or more layers, a first photosensitive layer (usually the layer adjacent to the support) contains the non-photosensitive organic silver salt and photosensitive silver halide, and some of other components should be contained in a second photosensitive layer or in both layers. A two layer structure containing a photosensitive monolayer containing all the components and a protective topcoat (surface protective layer) may be also acceptable. With respect to the structure of a multicolor heat developable photosensitive photographic material, a combination of these two layers may be adopted for each color, or all the components may be incorporated into a single layer as described in U.S. Pat. No. 4,707,928. In the case of the multicolor heat developable photosensitive photographic material, a functional or non-functional barrier layer may be provided between respective emulsion layers (respective photosensitive layers) as described in U.S. Pat. No. 4,460,681.

The heat developable photosensitive material according to the invention is preferably a so-called one face photosensitive material containing at least one photosensitive layer having an emulsion of silver halide on one surface of the support and a back layer on the other surface.

A matting agent may be added to the heat developable photosensitive material in order to improve transfer ability. The matting agent usually contains organic or inorganic fine particles which are generally insoluble in water. Any matting agents may be used and examples thereof include those known in the art such as organic matting agents described in U.S. Pat. Nos. 1,939,213, 2,701,245, 2,322,037, 3,262,782, 3,539,344 and 3,767,448; and inorganic matting agents described in U.S. Pat. Nos. 1,260,772, 2,192,241, 3,257,206, 3,370,951, 3,523,022 and 3,769,020. Preferable examples of the organic compounds available as the matting agent include water dispersible vinyl polymers such as polymethyl acrylate, polymethyl methacrylate, polyacrylonitrile, acrylonitrile-α-methyl styrene copolymer, polystyrene, styrene-divinylbenzene copolymer, polyvinyl acetate, polyethylene carbonate and polytetrafluoroethylene; cellulose derivatives such as methyl cellulose, cellulose acetate and cellulose acetate propionate; starch derivatives such as carboxylated starch, carboxylated nitrophenyl starch and urea-formaldehyde-starch reaction product; and gelatin cured with a curing agent known in the art and cured gelatin as a hollow powder of microcapsule prepared by coacervate curing. Preferable examples of the inorganic compounds available as the matting agent include silicon dioxide, titanium dioxide, magnesium dioxide, aluminum oxide, barium sulfate, calcium carbonate, silver chloride desensitized by a method known in the art, silver bromide desensitized by a method known in the art, glass powder and diatomaceous earth. The matting agent may be used by mixing with different kind of substances, if necessary. The size and shape of the matting agent are not particularly restricted, and those having an arbitrary particle diameter may be used. A diameter thereof is preferably 1 μm to 30 μm in the invention. Particle diameter distribution of the matting agent may be narrow or wide. Since the matting agent has great influence on haze and surface luster of the photosensitive material, it is preferable to adjust the particle diameter, particle shape and particle size distribution of the matting agent in the manufacturing process of the matting agent, or by mixing plural kinds of the matting agents.

Examples of the layers that may contain the matting agent in the invention include the outermost layer of all the layers, which are at the same side of the support as the photosensitive layer or the same side of the support as the back layer (the outermost layer may be a photosensitive layer or back layer), protective layer and undercoat layer. The matting agent is preferably incorporated in an outermost layer or a layer that functions as the outermost layer, or in a layer close to the outer surface. It is also preferable to incorporate the matting agent in the protective layer.

The back layer preferably has as a degree of matting Beck smoothness of 10 to 250 seconds, and more preferably 50 to 180 seconds.

A preferable binder of the back layer in the invention is colorless and transparent or semi-transparent and examples thereof include natural polymer resins, synthetic polymers or copolymers and other film forming media such as, for example, gelatin, gum arabic, polyvinyl alcohol, hydroxyethyl cellulose, cellulose acetate, cellulose acetate butylate, polyvinylpyrrolidone, casein, starch, polyacrylic acid, polymethylmethacrylic acid, polyvinyl chloride, polymethacrylic acid, styrene-maleic anhydride copolymer, styrene-acrylonitrile copolymer, styrene-butadiene copolymer, polyvinylacetal such as polyvinylformal and polyvinylbutyral, polyester, polyurethane, phenoxy resin, polyvinylidene chloride, polyepoxide, polycarbonate, polyvinyl acetate, cellulose esters and polyamide. The binder may be coated from an aqueous or organic solution, or from an emulsion.

A backside resistive heating layer as disclosed in U.S. Pat. Nos. 4,460,681 and 4,374,921 may be used in the photosensitive heat developable photographic imaging system.

A film-hardener may be used in each layer such as the photosensitive layer, protective layer and back layer of the heat developable photosensitive material according to the invention. Examples thereof include polyisocyanate described in U.S. Pat. No. 4,281,060 and JP-A No. 6-208193; epoxy compounds described in U.S. Pat. No. 4,791,042; and vinylsulfone compounds described in JP-A No. 62-89048.

A surfactant may be used in the heat developable photosensitive material of the invention in order to improve coating ability and improve an electrification property. Any surfactants such as nonionic, anionic, cationic and fluorinated surfactants may be appropriately used. Examples thereof include fluorinated polymer surfactants described in JP-A No. 62-170950 and U.S. Pat. No. 5,380,644; fluorinated surfactants described in JP-A Nos. 60-244945 and 63-188135; polysiloxane surfactants described in U.S. Pat. No. 3,885,965; and polyalkylene oxide and anionic surfactants described in JP-A No. 6-301140.

Examples of the solvents to be used in the invention include those described in Solvent Pocket Book, new edition (Ohm Co., published in 1994), but the invention is not restricted thereto. The solvent to be used in the invention preferably has a boiling point of 40 to 180° C.

Examples of the solvent to be used in the invention include hexane, cyclohexane, toluene, methanol, ethanol, isopropanol, acetone, methyl ethyl ketone, ethyl acetate, 1,1,1-trichloroethane, tetrahydrofuran, triethylamine, thiophene, trifluoroethanol, perfluoropentane, xylene, n-butanol, phenol, methyl isobutyl ketone, cyclohexanone, butyl acetate, diethyl carbonate, chlorobenzene, dibutyl ether, anisole, ethylene glycol diethyl ether, N,N-dimethylformamide, morpholine, propane sultone, perfluorotributylamine and water.

The photosensitive layer of the heat developable photosensitive material according to the invention may be provided on various supports. Examples of the support include polyester film, undercoated polyester film, polyethylene terephthalate film, polyethylene naphthalate film, cellulose nitrate film, cellulose ester film, polyvinyl acetal film, polycarbonate film and related resin materials, and glass, paper and metal. A flexible support such as partially acetylated paper, or paper coated with baryta and/or α-olefin polymer, in particular coated with a polymer of α-olefin having 2 to 10 carbon atoms such as polyethylene, polypropylene, and ethylene-butene copolymer are typically used as the support. Although the support may be transparent or opaque, a transparent support is preferable.

The heat developable photosensitive material according to the invention may contain an electrification preventive layer or a conductive layer such as a layer of a soluble salt (such as chlorides and nitrates), a metal film by vapor deposition, an ionic polymer as described in U.S. Pat. Nos. 2,861,056 and 3,206,312, or an insoluble inorganic salt as described in U.S. Pat. No. 3,428,451.

The method for obtaining a color image using the heat developable photosensitive material according to the invention is described in p. 10, line 43 to p. 11, line 40 of JP-A No. 7-13295. Stabilizers of the color dye image are exemplified in U.K. Patent No. 1,326,889, U.S. Pat. Nos. 3,432,300, 3,698,909, 3,574,627, 3,573,050, 3,764,337 and 4,042,394.

The heat developable photographic emulsion used in the invention may be coated by various coating operations including dip coating, air knife coating, flow coating or extrusion coating using a hopper as described in U.S. Pat. No. 2,681,294. Two or more layers may be simultaneously coated, if desired, by the method described in U.S. Pat. No. 2,761,791 and U.K. Patent No. 837,095.

The heat developable photosensitive material according to the invention may contain additional layers, for example a dye accepting layer for accepting mobile dye images, an opaque layer when reflection printing is required, a protective topcoat layer (surface protective layer), and a primer layer known in the photothermal photographic art. It is preferable that images are formed by only one photosensitive material of the invention, or functional layers required for imaging such as an image receiving layer does not work as a different photosensitive material.

The photosensitive material of the invention may be developed by any method, but it is usually developed by heating the photosensitive material after imagewise exposure. Development temperature is preferably 80 to 250° C. and more preferably 100 to 140° C. The development time is preferably 1 to 180 seconds, and more preferably 10 to 90 seconds. A development method using a heat drum is preferable.

The photosensitive material of the invention may be exposed by any method, but a laser beam is preferable as the exposure light source. A preferable laser in the invention is a gas laser, dye laser and semiconductor laser. An element that generates a secondary harmonic wave may be used together with the semiconductor laser or YAG laser.

Examples

<Preparation of Photosensitive Silver Halide Emulsion>

88.3 g of phenylcarbamoyl gelatin, 10 ml of 10% by mass solution of a PAO compound $[HO(CH_2CH_2O)_n—(CH(CH_3)CH_2)_{17}—(CH_2CH_2O)_m—H$; m+n=5 to 7] in methanol and 0.32 g of potassium bromide were dissolved in 5429 ml of water and maintained at 45° C. 659 ml of 0.67 mol/l aqueous solution of silver nitrate, and a solution prepared by dissolving 0.703 mol of KBr and 0.013 mol of KI in one liter of water were added into this solution over 4.75 minutes using a mixing stirrer disclosed in JP-B Nos. 58-58288 and 58-58289 by a simultaneous mixing method while controlling the pAg value to 8.09, thereby forming nuclei. One minute later, 20 ml of a 0.63N potassium hydroxide aqueous solution was added to the resultant solution. Six minutes later, 1976 ml of 0.67 mol/l aqueous solution of silver nitrate, and a solution of 0.657 mol of KBr, 0.013 mol of KI and 30 μmol of dipotassium hexachloroiridate in one litter of water were added thereto over 14 minutes 15 seconds by a simultaneous mixing method while controlling the pAg value to 8.09. After stirring for five minutes, the solution was cooled to 40° C.

Silver halide emulsion was allowed to precipitate by adding 18 ml of 56% by mass of aqueous acetic acid solution to the solution obtained as described above. The supernatant was removed while leaving two liters of the precipitate behind, and the silver halide emulsion was allowed to precipitate again after adding 10 liters of water and stirring. The supernatant was removed again with 1.5 liter of the precipitate left behind. Ten liters of water was added to the precipitate again, and silver halide emulsion was allowed to precipitate after stirring. After removing the supernatant with 1.5 liters of the precipitate left behind, a solution prepared by dissolving 1.72 g of anhydrous sodium carbonate in 151 ml of water was added to the precipitate, and the solution was heated to 60° C. and further stirred for 120 minutes. The pH was finally adjusted to 5.0, and water was added to the solution so that the amount of water was 1161 g per one mol of silver.

The emulsion contained monodisperse cubic silver bromide particles with an average particle size of 0.058 μm, variation coefficient of the particle size of 12%, and the ratio of the [100] face of 92%.

<Preparation of Organic Silver Salt Powder A to H>

Behenic acid, arachidic acid and stearic acid with total moles of 0.7552 mol were added to 4720 ml of pure water in the proportions described in Table 1. After dissolving the mixture at 80° C., 540.2 ml of 1.5N aqueous sodium hydroxide solution was added to the solution and, after adding 6.9 ml of conc. nitric acid, the solution was cooled to 55° C. to obtain a solution of organic acid sodium salt. The silver halide emulsion (45.3 g) and pure water (450 ml) were added to the organic acid sodium salt solution while keeping the temperature of the solution at 55° C., and the mixture was stirred for 5 minutes at 13,200 rpm (mechanical vibration frequency of 21.1 KHz) using a homogenizer (ULTRA-TURRAX T-25) made by IKA JAPAN Co. Subsequently, 702.6 ml of a 1 mol/liter of silver nitrate solution was added to the resultant dispersion over two minutes followed by stirring the dispersion for ten minutes to obtain a dispersion of the organic silver salt. The dispersion of the organic silver salt was transferred to a washing vessel and, after adding deionized water thereto and stirring the resultant mixture, the mixture was allowed to stand still in order to separate floating dispersion of the organic silver salt and then water soluble salts in the lower solution were removed. Thereafter washing with deionized water and draining were repeated until electrical conductivity decreased to 2 μS/cm. After dehydration by centrifugation, the product was dried by warm air until no weight loss was observed at 40° C. under an oxygen partial pressure shown in Table 1, thereby obtaining the organic silver salt powder.

TABLE 1

| Organic silver salt | Behenic acid (mol %) | Arachidic acid (mol %) | Stearic acid (mol %) | Oxygen partial pressure (vol %) |
|---|---|---|---|---|
| A | 50 | 30 | 20 | 10 |
| B | 55 | 27 | 18 | 10 |
| C | 60 | 24 | 16 | 10 |
| D | 65 | 21 | 14 | 10 |
| E | 73 | 16 | 11 | 10 |
| F | 78 | 13 | 9 | 10 |
| G | 83 | 10 | 7 | 10 |
| H | 88 | 7 | 5 | 10 |

<Preparation of Photosensitive Emulsion>

A slurry was obtained by slowly adding 500 g of the organic silver salt powder into a solution of 14.57 g of polyvinyl butyral powder (Butvar B-79 made by Monsanto Co.) in 1457 g of methyl ethyl ketone (MEK) which solution was thoroughly stirred with dissolver DISPERMAT type CA-40M made by TZMANN Co. A photosensitive emulsion was prepared by dispersing the slurry by dual bus dispersion with a GM-2 type pressurizing homogenizer made by SMT Co. The processing pressure in the first pass was 280 kg/cm$^2$, and the processing pressure in the second pass was 560 kg/cm$^2$.

<Preparation of Photosensitive Layer Coating Solutions 1 to 120>

15.1 g of MEK was added to 50 g of the photosensitive emulsion, and 390 μl of 10% by weight methanol solution of a molecular association of two molecules of N,N-dimethylacetamide, one molecule of hydrobromic acid and one molecule of bromine was added to the emulsion while keeping the temperature of the emulstion at 21° C. and stirring the emulstion at 1000 rpm with a dissolver type homogenizer and the resultant mixture was stirred for one hour. Stirring was continued for an additional 20 minutes after adding 494 μl of 10% by mass of methanol solution of calcium bromide. Subsequently, after adding 167 mg of a methanol solution containing 15.9% by mass of dibenzo-18-crown-6 and 4.9% by mass of potassium acetate to the emulsion and stirring the mixture for ten minutes, 2.6 g of a MEK solution containing 0.24% by mass of Colorant A, 18.3% by mass of 2-chlorobenzoic acid, 34.2% by mass of salicylic acid-p-toluenesulfonate and 4.5% by mass of 5-methyl-2-mercaptobenzimidazole were added to the mixture and the resultant mixture was stirred for one hour. The mixture was cooled to 13° C. and further stirred for 30 minutes. After adding 13.31 g of polyvinyl butyral (Butvar B-79 made by Monsanto Co.) while keeping the temperature of the mixture at 13° C. and stirring the resultant mixture for 30 minutes, 1.08 g of a 9.4% by mass tetrachlorophthalic acid solution was added to the mixture and the resultant mixture was stirred for 15 minutes. The compounds represented by General formulas (1) and (2) were added to the mixture in the amounts shown in Tables 2 to 5, followed by adding the same mole of a hydrogen-bonding compound A as that of the compound represented by General formula (1), a development accelerator A in the amount shown in Tables 2 to 5, 12.4 g of a MEK solution containing 1.1% by mass of 4-methylphthalic acid and dye A, 1.5 g of 10% by mass of Desmodur N3300 (aliphatic isocyanate made by Mobey Co.), and 4.27 g of a MEK solution containing 7.4% by mass tribromomethyl-2-azaphenylsulfone and 7.2% by mass of phthalazine while continuously stirring the mixture, thereby obtaining the photosensitive layer coating solutions 1 to 20.

Tg of the binder contained in the photosensitive layer in the example was 68° C.

TABLE 2

| Heat developable photosensitive material | Organic silver salt | Amount of coating of Ag ($g/m^2$) | Compound of General formula (1) kind | Compound of General formula (1) mole/mole Ag | Compound of General formula (2) kind | Compound of General formula (2) mole/mole Ag | Development accelerator-a Mole/mole Ag |
|---|---|---|---|---|---|---|---|
| 1 | A | 1.7 | 1-1 | $4 \times 10^{-1}$ | — | — | — |
| 2 | A | 1.7 | 1-1 | $4 \times 10^{-1}$ | 2-8 | $5 \times 10^{-2}$ | — |
| 3 | A | 1.7 | 1-1 | $4 \times 10^{-1}$ | 2-16 | $5 \times 10^{-2}$ | — |
| 4 | B | 1.7 | 1-1 | $4 \times 10^{-1}$ | — | — | — |
| 5 | B | 1.7 | 1-1 | $4 \times 10^{-1}$ | 2-8 | $5 \times 10^{-2}$ | — |
| 6 | B | 1.7 | 1-1 | $4 \times 10^{-1}$ | 2-16 | $5 \times 10^{-2}$ | — |
| 7 | C | 1.7 | 1-1 | $4 \times 10^{-1}$ | — | — | — |
| 8 | C | 1.7 | 1-1 | $4 \times 10^{-1}$ | 2-8 | $5 \times 10^{-2}$ | — |
| 9 | C | 1.7 | 1-1 | $4 \times 10^{-1}$ | 2-16 | $5 \times 10^{-2}$ | — |
| 10 | D | 1.7 | 1-1 | $4 \times 10^{-1}$ | — | — | — |
| 11 | D | 1.7 | 1-1 | $4 \times 10^{-1}$ | 2-8 | $5 \times 10^{-2}$ | — |
| 12 | D | 1.7 | 1-1 | $4 \times 10^{-1}$ | 2-16 | $5 \times 10^{-2}$ | — |
| 13 | E | 1.7 | 1-1 | $4 \times 10^{-1}$ | — | — | — |
| 14 | E | 1.7 | 1-1 | $4 \times 10^{-1}$ | 2-8 | $5 \times 10^{-2}$ | — |
| 15 | E | 1.7 | 1-1 | $4 \times 10^{-1}$ | 2-16 | $5 \times 10^{-2}$ | — |
| 16 | F | 1.7 | 1-1 | $4 \times 10^{-1}$ | — | — | — |
| 17 | F | 1.7 | 1-1 | $4 \times 10^{-1}$ | 2-8 | $5 \times 10^{-2}$ | — |
| 18 | F | 1.7 | 1-1 | $4 \times 10^{-1}$ | 2-16 | $5 \times 10^{-2}$ | — |
| 19 | G | 1.7 | 1-1 | $4 \times 10^{-1}$ | — | — | — |
| 20 | G | 1.7 | 1-1 | $4 \times 10^{-1}$ | 2-8 | $5 \times 10^{-2}$ | — |
| 21 | G | 1.7 | 1-1 | $4 \times 10^{-1}$ | 2-16 | $5 \times 10^{-2}$ | — |
| 22 | H | 1.7 | 1-1 | $4 \times 10^{-1}$ | — | — | — |
| 23 | H | 1.7 | 1-1 | $4 \times 10^{-1}$ | 2-8 | $5 \times 10^{-2}$ | — |
| 24 | H | 1.7 | 1-1 | $4 \times 10^{-1}$ | 2-16 | $5 \times 10^{-2}$ | — |
| 25 | D | 2.1 | 1-1 | $4 \times 10^{-1}$ | — | — | — |
| 26 | D | 2.1 | 1-1 | $4 \times 10^{-1}$ | 2-8 | $5 \times 10^{-2}$ | — |
| 27 | D | 2.1 | 1-1 | $4 \times 10^{-1}$ | 2-16 | $5 \times 10^{-2}$ | — |
| 28 | D | 1.7 | 1-1 | $4 \times 10^{-1}$ | — | — | $1 \times 10^{-2}$ |
| 29 | D | 1.7 | 1-1 | $4 \times 10^{-1}$ | 2-8 | $5 \times 10^{-2}$ | $1 \times 10^{-2}$ |
| 30 | D | 1.7 | 1-1 | $4 \times 10^{-1}$ | 2-16 | $5 \times 10^{-2}$ | $1 \times 10^{-2}$ |

TABLE 3

| Heat developable photosensitive material | Organic silver salt | Amount of coating of Ag ($g/m^2$) | Compound of General formula (1) kind | Compound of General formula (1) mole/mole Ag | Compound of General formula (2) kind | Compound of General formula (2) mole/mole Ag | Development accelerator-a Mole/mole Ag |
|---|---|---|---|---|---|---|---|
| 31 | A | 1.7 | 1-5 | $3 \times 10^{-1}$ | — | — | — |
| 32 | A | 1.7 | 1-5 | $3 \times 10^{-1}$ | 2-8 | $5 \times 10^{-2}$ | — |
| 33 | A | 1.7 | 1-5 | $3 \times 10^{-1}$ | 2-16 | $5 \times 10^{-2}$ | — |
| 34 | B | 1.7 | 1-5 | $3 \times 10^{-1}$ | — | — | — |
| 35 | B | 1.7 | 1-5 | $3 \times 10^{-1}$ | 2-8 | $5 \times 10^{-2}$ | — |
| 36 | B | 1.7 | 1-5 | $3 \times 10^{-1}$ | 2-16 | $5 \times 10^{-2}$ | — |
| 37 | C | 1.7 | 1-5 | $3 \times 10^{-1}$ | — | — | — |
| 38 | C | 1.7 | 1-5 | $3 \times 10^{-1}$ | 2-8 | $5 \times 10^{-2}$ | — |
| 39 | C | 1.7 | 1-5 | $3 \times 10^{-1}$ | 2-16 | $5 \times 10^{-2}$ | — |
| 40 | D | 1.7 | 1-5 | $3 \times 10^{-1}$ | — | — | — |
| 41 | D | 1.7 | 1-5 | $3 \times 10^{-1}$ | 2-8 | $5 \times 10^{-2}$ | — |
| 42 | D | 1.7 | 1-5 | $3 \times 10^{-1}$ | 2-16 | $5 \times 10^{-2}$ | — |

TABLE 3-continued

| Heat developable photosensitive material | Organic silver salt | Amount of coating of Ag ($g/m^2$) | Compound of General formula (1) kind | Compound of General formula (1) mole/mole Ag | Compound of General formula (2) kind | Compound of General formula (2) mole/mole Ag | Development accelerator-a Mole/mole Ag |
|---|---|---|---|---|---|---|---|
| 43 | E | 1.7 | 1-5 | $3 \times 10^{-1}$ | — | — | — |
| 44 | E | 1.7 | 1-5 | $3 \times 10^{-1}$ | 2-8 | $5 \times 10^{-2}$ | — |
| 45 | E | 1.7 | 1-5 | $3 \times 10^{-1}$ | 2-16 | $5 \times 10^{-2}$ | — |
| 46 | F | 1.7 | 1-5 | $3 \times 10^{-1}$ | — | — | — |
| 47 | F | 1.7 | 1-5 | $3 \times 10^{-1}$ | 2-8 | $5 \times 10^{-2}$ | — |
| 48 | F | 1.7 | 1-5 | $3 \times 10^{-1}$ | 2-16 | $5 \times 10^{-2}$ | — |
| 49 | G | 1.7 | 1-5 | $3 \times 10^{-1}$ | — | — | — |
| 50 | G | 1.7 | 1-5 | $3 \times 10^{-1}$ | 2-8 | $5 \times 10^{-2}$ | — |
| 51 | G | 1.7 | 1-5 | $3 \times 10^{-1}$ | 2-16 | $5 \times 10^{-2}$ | — |
| 52 | H | 1.7 | 1-5 | $3 \times 10^{-1}$ | — | — | — |
| 53 | H | 1.7 | 1-5 | $3 \times 10^{-1}$ | 2-8 | $5 \times 10^{-2}$ | — |
| 54 | H | 1.7 | 1-5 | $3 \times 10^{-1}$ | 2-16 | $5 \times 10^{-2}$ | — |
| 55 | D | 2.1 | 1-5 | $3 \times 10^{-1}$ | — | — | — |
| 56 | D | 2.1 | 1-5 | $3 \times 10^{-1}$ | 2-8 | $5 \times 10^{-2}$ | — |
| 57 | D | 2.1 | 1-5 | $3 \times 10^{-1}$ | 2-16 | $5 \times 10^{-2}$ | — |
| 58 | D | 1.7 | 1-5 | $3 \times 10^{-1}$ | — | — | $1 \times 10^{-2}$ |
| 59 | D | 1.7 | 1-5 | $3 \times 10^{-1}$ | 2-8 | $5 \times 10^{-2}$ | $1 \times 10^{-2}$ |
| 60 | D | 1.7 | 1-5 | $3 \times 10^{-1}$ | 2-16 | $5 \times 10^{-2}$ | $1 \times 10^{-2}$ |

TABLE 4

| Heat developable photosensitive material | Organic silver salt | Amount of coating of Ag ($g/m^2$) | Compound of General formula (1) kind | Compound of General formula (1) mole/mole Ag | Compound of General formula (2) kind | Compound of General formula (2) mole/mole Ag | Development accelerator-a Mole/mole Ag |
|---|---|---|---|---|---|---|---|
| 61 | A | 1.7 | 1-2 | $4.5 \times 10^{-1}$ | — | — | — |
| 62 | A | 1.7 | 1-2 | $4.5 \times 10^{-1}$ | 2-8 | $5 \times 10^{-2}$ | — |
| 63 | A | 1.7 | 1-2 | $4.5 \times 10^{-1}$ | 2-16 | $5 \times 10^{-2}$ | — |
| 64 | B | 1.7 | 1-2 | $4.5 \times 10^{-1}$ | — | — | — |
| 65 | B | 1.7 | 1-2 | $4.5 \times 10^{-1}$ | 2-8 | $5 \times 10^{-2}$ | — |
| 66 | B | 1.7 | 1-2 | $4.5 \times 10^{-1}$ | 2-16 | $5 \times 10^{-2}$ | — |
| 67 | C | 1.7 | 1-2 | $4.5 \times 10^{-1}$ | — | — | — |
| 68 | C | 1.7 | 1-2 | $4.5 \times 10^{-1}$ | 2-8 | $5 \times 10^{-2}$ | — |
| 69 | C | 1.7 | 1-2 | $4.5 \times 10^{-1}$ | 2-16 | $5 \times 10^{-2}$ | — |
| 70 | D | 1.7 | 1-2 | $4.5 \times 10^{-1}$ | — | — | — |
| 71 | D | 1.7 | 1-2 | $4.5 \times 10^{-1}$ | 2-8 | $5 \times 10^{-2}$ | — |
| 72 | D | 1.7 | 1-2 | $4.5 \times 10^{-1}$ | 2-16 | $5 \times 10^{-2}$ | — |
| 73 | E | 1.7 | 1-2 | $4.5 \times 10^{-1}$ | — | — | — |
| 74 | E | 1.7 | 1-2 | $4.5 \times 10^{-1}$ | 2-8 | $5 \times 10^{-2}$ | — |
| 75 | E | 1.7 | 1-2 | $4.5 \times 10^{-1}$ | 2-16 | $5 \times 10^{-2}$ | — |
| 76 | F | 1.7 | 1-2 | $4.5 \times 10^{-1}$ | — | — | — |
| 77 | F | 1.7 | 1-2 | $4.5 \times 10^{-1}$ | 2-8 | $5 \times 10^{-2}$ | — |
| 78 | F | 1.7 | 1-2 | $4.5 \times 10^{-1}$ | 2-16 | $5 \times 10^{-2}$ | — |
| 79 | G | 1.7 | 1-2 | $4.5 \times 10^{-1}$ | — | — | — |
| 80 | G | 1.7 | 1-2 | $4.5 \times 10^{-1}$ | 2-8 | $5 \times 10^{-2}$ | — |
| 81 | G | 1.7 | 1-2 | $4.5 \times 10^{-1}$ | 2-16 | $5 \times 10^{-2}$ | — |
| 82 | H | 1.7 | 1-2 | $4.5 \times 10^{-1}$ | — | — | — |
| 83 | H | 1.7 | 1-2 | $4.5 \times 10^{-1}$ | 2-8 | $5 \times 10^{-2}$ | — |
| 84 | H | 1.7 | 1-2 | $4.5 \times 10^{-1}$ | 2-16 | $5 \times 10^{-2}$ | — |
| 85 | D | 2.1 | 1-2 | $4.5 \times 10^{-1}$ | — | — | — |
| 86 | D | 2.1 | 1-2 | $4.5 \times 10^{-1}$ | 2-8 | $5 \times 10^{-2}$ | — |
| 87 | D | 2.1 | 1-2 | $4.5 \times 10^{-1}$ | 2-16 | $5 \times 10^{-2}$ | — |
| 88 | D | 1.7 | 1-2 | $4.5 \times 10^{-1}$ | — | — | $1 \times 10^{-2}$ |
| 89 | D | 1.7 | 1-2 | $4.5 \times 10^{-1}$ | 2-8 | $5 \times 10^{-2}$ | $1 \times 10^{-2}$ |
| 90 | D | 1.7 | 1-2 | $4.5 \times 10^{-1}$ | 2-16 | $5 \times 10^{-2}$ | $1 \times 10^{-2}$ |

TABLE 5

| Heat developable photosensitive material | Organic silver salt | Amount of coating of Ag ($g/m^2$) | Compound of General formula (1) kind | Compound of General formula (1) mole/mole Ag | Compound of General formula (2) kind | Compound of General formula (2) mole/mole Ag | Development accelerator-a Mole/mole Ag |
|---|---|---|---|---|---|---|---|
| 91 | A | 1.7 | 1-6 | $3 \times 10^{-1}$ | — | — | |
| 92 | A | 1.7 | 1-6 | $3 \times 10^{-1}$ | 2-8 | $5 \times 10^{-2}$ | — |
| 93 | A | 1.7 | 1-6 | $3 \times 10^{-1}$ | 2-16 | $5 \times 10^{-2}$ | — |
| 94 | B | 1.7 | 1-6 | $3 \times 10^{-1}$ | — | — | — |
| 95 | B | 1.7 | 1-6 | $3 \times 10^{-1}$ | 2-8 | $5 \times 10^{-2}$ | — |
| 96 | B | 1.7 | 1-6 | $3 \times 10^{-1}$ | 2-16 | $5 \times 10^{-2}$ | — |

TABLE 5-continued

| Heat developable photosensitive material | Organic silver salt | Amount of coating of Ag ($g/m^2$) | Compound of General formula (1) kind | Compound of General formula (1) mole/mole Ag | Compound of General formula (2) kind | Compound of General formula (2) mole/mole Ag | Development accelerator-a Mole/mole Ag |
|---|---|---|---|---|---|---|---|
| 97 | C | 1.7 | 1-6 | $3 \times 10^{-1}$ | — | — | — |
| 98 | C | 1.7 | 1-6 | $3 \times 10^{-1}$ | 2-8 | $5 \times 10^{-2}$ | — |
| 99 | C | 1.7 | 1-6 | $3 \times 10^{-1}$ | 2-16 | $5 \times 10^{-2}$ | — |
| 100 | D | 1.7 | 1-6 | $3 \times 10^{-1}$ | — | — | — |
| 101 | D | 1.7 | 1-6 | $3 \times 10^{-1}$ | 2-8 | $5 \times 10^{-2}$ | — |
| 102 | D | 1.7 | 1-6 | $3 \times 10^{-1}$ | 2-16 | $5 \times 10^{-2}$ | — |
| 103 | E | 1.7 | 1-6 | $3 \times 10^{-1}$ | — | — | — |
| 104 | E | 1.7 | 1-6 | $3 \times 10^{-1}$ | 2-8 | $5 \times 10^{-2}$ | — |
| 105 | E | 1.7 | 1-6 | $3 \times 10^{-1}$ | 2-16 | $5 \times 10^{-2}$ | — |
| 106 | F | 1.7 | 1-6 | $3 \times 10^{-1}$ | — | — | — |
| 107 | F | 1.7 | 1-6 | $3 \times 10^{-1}$ | 2-8 | $5 \times 10^{-2}$ | — |
| 108 | F | 1.7 | 1-6 | $3 \times 10^{-1}$ | 2-16 | $5 \times 10^{-2}$ | — |
| 109 | G | 1.7 | 1-6 | $3 \times 10^{-1}$ | — | — | — |
| 110 | G | 1.7 | 1-6 | $3 \times 10^{-1}$ | 2-8 | $5 \times 10^{-2}$ | — |
| 111 | G | 1.7 | 1-6 | $3 \times 10^{-1}$ | 2-16 | $5 \times 10^{-2}$ | — |
| 112 | H | 1.7 | 1-6 | $3 \times 10^{-1}$ | — | — | — |
| 113 | H | 1.7 | 1-6 | $3 \times 10^{-1}$ | 2-8 | $5 \times 10^{-2}$ | — |
| 114 | H | 1.7 | 1-6 | $3 \times 10^{-1}$ | 2-16 | $5 \times 10^{-2}$ | — |
| 115 | D | 2.1 | 1-6 | $3 \times 10^{-1}$ | — | — | — |
| 116 | D | 2.1 | 1-6 | $3 \times 10^{-1}$ | 2-8 | $5 \times 10^{-2}$ | — |
| 117 | D | 2.1 | 1-6 | $3 \times 10^{-1}$ | 2-16 | $5 \times 10^{-2}$ | — |
| 118 | D | 1.7 | 1-6 | $3 \times 10^{-1}$ | — | — | $1 \times 10^{-2}$ |
| 119 | D | 1.7 | 1-6 | $3 \times 10^{-1}$ | 2-8 | $5 \times 10^{-2}$ | $1 \times 10^{-2}$ |
| 120 | D | 1.7 | 1-6 | $3 \times 10^{-1}$ | 2-16 | $5 \times 10^{-2}$ | $1 \times 10^{-2}$ |

<Preparation of Surface Protective Coating Solution>

After adding and dissolving 96 g of cellulose acetate butyrate (CAB 171-15 made by Eastman Chemical Co.), 4.5 g of polymethylmethacrylic acid (Paraoid A-21 made by Rohm & Haas Co.), 1.5 g of 1,3-di(vinylsulfonyl)-2-propanol, 11.0 g of benzotriazole and 1.0 g of fluorinated surfactant (Surflon KH40 made by Asahi Glass Co.) in 865 g of MEK while MEK was stirred, 30 g of a dispersion in which 13.6% by mass of cellulose acetate butyrate (CAB 171-15 made by Eastman Chemical Co.) and 9% by mass of calcium carbonate (Super-Pflex 200 made by Specialty Minerals Co.) had been dispersed in MEK with a dissolver type homogenizer at 8000 rpm for 30 minutes was added thereto and stirred to prepare the surface protective coating solution.

<Manufacture of Support>

Both surfaces of a PET film colored blue with a density of 0.170 (measured by Macbeth Densitometer TD-904) and having a thickness of 175 μm was treated with corona discharge at an energy of 8 $W/m^2$ min.

<Coating of Back Layer>

84.2 g of cellulose acetate butylate (CAB 381-20 made by Eastman Chemical Co.) and 4.5 g of polyester resin (Vitel PE2200B made by Bostic Co.) were added and dissolved into 830 g of MEK while MEK was stired. 0.30 g of dye B was added into the dissolved solution, followed by adding thereto a solution in which 4.5 g of fluorinated surfactant (Surflon KH40 made by Asahi Glass Co.) and 2.3 g of fluorinated surfactant (Megafacs F120K made by Dainippon Ink and Chemicals, Inc.) were dissolved in 43.2 g of methanol and thoroughly stirring the mixture so that the solutes were dissolved. Finally, 75 g of silica (Siloid 64×6000 made by W. R. Grace Co.) dispersed in methyl ethyl ketone in a silica concentration of 1% by mass with a dissolver type homogenizer was added to the resultant solution and the resultant mixture was stirred to prepare a coating solution for the back layer.

The back layer coating solution prepared as described above was applied to the support by an extrusion coater so that the thickness thereof was 3.5 μm and the applied layer was dried for five minutes by dry air with a drying temperature of 100° C. and a dew point temperature of 10° C.

<Manufacture of Heat Developable Photosensitive Material>

The heat developable photosensitive materials 1 to 120 were manufactured, respectively, by simultaneously applying the photosensitive coating solutions 1 to 120 and surface protective layer coating solution on respective supports having a back layer. The amount of each photosensitive layer is represented by the amount of applied silver. The thickness of the surface protective layer after drying was 2.5 μm. Each photosensitive material was dried for 10 minutes by dry air with a drying temperature of 75° C. and dew point temperature of 10° C.

The sum of the contents of methanol and MEK determined as follows was defined as the solvent contents of the heat developable photosensitive materials 1 to 120 manufactured as described above. A film with an area of 46.3 $cm^2$ was cut, and the film was cut into small pieces with a width of 5 mm, and the small pieces of the film were placed in a special vial. After tightly sealing the vial with a septum and aluminum cap, the vial was set in a head space sampler HP 7694 of a gas chromatographic apparatus 5971 made by Hewlett-Packard Co. The GC detector used was a hydrogen flame ionization detector (FID), and the column used was DB-624 made by J & W Co.

The head space sampler was heated at 120° C. for 20 minutes, and the GC sample was introduced at 150° C. to the column that was kept at 45° C. and the temperature of column was kept for 3 minutes and then the column was heated from 45° C. to 100° C. at a heating speed of 8° C./minute. The calibration curve was obtained by measuring the peak area of the chromatogram obtained by measuring samples, each of which contained a definite quantity of each solvent diluted with butanol in a special vial. The content of the solvent in the photosensitive material was 40 $mg/m^2$.

The heat developable photosensitive material was cut into an area of 100 $cm^2$, and the photosensitive layer was peeled off in MEK. The photosensitive layer was decomposed with a mixed solvent of sulfuric acid and nitric acid in a micro-digest A300 type microwave wet decomposition apparatus made by Pro-Labo Co., and the decomposition product was assayed by a calibration curve method using PQ-Ω type ICP-MS (induction coupling plasma mass-spectrometer) finding that the content of Zr in the heat developable photosensitive material was 10 μg or less per 1 mg of Ag.

Exposure and Development Treatment

An exposure apparatus using a vertical multi-mode semiconductor laser with an wavelength region of 800 nm to 820 nm by high frequency superposition was constructed, and the photosensitive materials were exposed to light from the emulsion side thereof by scanning the laser beam from the exposure apparatus. The images were recorded with an incident angle of the scanning laser beam being 75° to the exposure surface of the photosensitive material. The images were developed at 124° C. for 15 seconds using an automatic developing machine having a heat drum so that the protective layer of the photosensitive material brought into contact with the surface of the drum. The images obtained were evaluated using a densitometer. The temperature and humidity of the room used for exposure and development were 23° C. and 50% RH, respectively.

This exposure condition caused little deterioration of the images due to interference irregularity, as compared with the image recorded using a conventional scanning laser beam with an incident angle of 90° to the exposure surface of the photosensitive material. The image showed unexpectedly excellent sharpness and contrast.

The compounds used in this example are shown below:

Colorant A

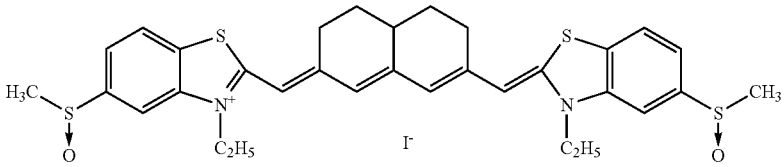

Hydrogen bonding compound A

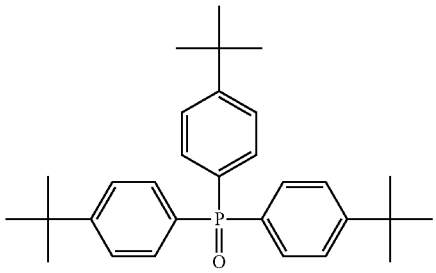

Development accelerator A

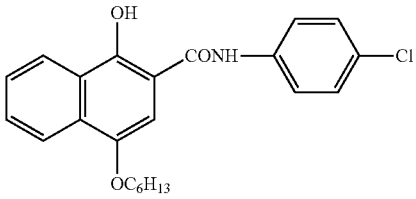

Dye A

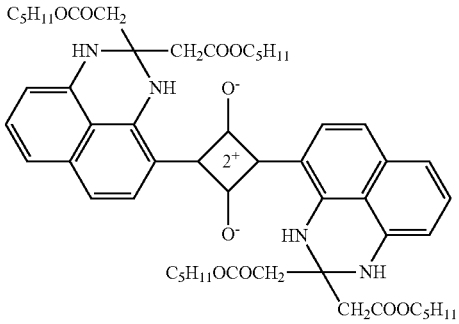

Dye B

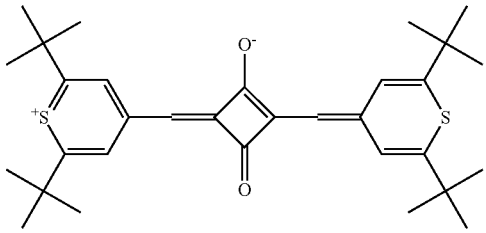

Evaluation of Photographic Performance

After each sample of the heat developable photosensitive materials 1 to 120 obtained as described above was exposed to the laser and heat-developed by the method as described above, the relative sensitivity, maximum image density ($D_{max}$) and minimum density ($D_{min}$) were measured. The relative sensitivity was evaluated by assuming the sensitivity of the heat developable photosensitive material-11 to be 100. The results are shown in Tables 6 to 9.

The heat developable photosensitive material was developed using four panel heaters set at 124° C. for 15 seconds and the photographic performance thereof was evaluated.

Evaluation of Preservative Property of the Image

The photographic material was exposed to light by the exposure method as described above, heat-developed, sufficiently exposed to light, placed in an atmosphere of 70% RH for 3 hours and put in a light-shielding bag. The bag was sealed and then allowed to stand at 60° C. for 72 hours.

The results are shown in Tables 6 to 9.

TABLE 6

| Heat developable photosensitive material | Note | Relative sensitivity | Image density ($D_{max}$) | Fog ($D_{min}$) | Image preservation property (rate of change of $D_{min}$) |
|---|---|---|---|---|---|
| 1 | Comparative example | 106 | 3.52 | 0.30 | 30 |
| 2 | Comparative example | 110 | 3.92 | 0.30 | 30 |
| 3 | Comparative example | 110 | 3.93 | 0.30 | 30 |
| 4 | Comparative example | 100 | 3.51 | 0.24 | 15 |
| 5 | Example of the invention | 104 | 3.91 | 0.24 | 15 |
| 6 | Example of the invention | 104 | 3.92 | 0.24 | 15 |
| 7 | Comparative example | 98 | 3.50 | 0.22 | 12 |
| 8 | Example of the invention | 102 | 3.90 | 0.22 | 12 |
| 9 | Example of the invention | 102 | 3.91 | 0.22 | 12 |
| 10 | Comparative example | 96 | 3.49 | 0.20 | 10 |
| 11 | Example of the invention | 100 | 3.89 | 0.20 | 10 |
| 12 | Example of the invention | 100 | 3.90 | 0.20 | 10 |
| 13 | Comparative example | 88 | 3.48 | 0.19 | 8 |
| 14 | Example of the invention | 98 | 3.88 | 0.19 | 8 |
| 15 | Example of the invention | 98 | 3.89 | 0.19 | 8 |
| 16 | Comparative example | 91 | 3.42 | 0.18 | 7 |
| 17 | Example of the invention | 95 | 3.82 | 0.18 | 7 |
| 18 | Example of the invention | 95 | 3.83 | 0.18 | 7 |
| 19 | Comparative example | 86 | 3.30 | 0.18 | 6 |
| 20 | Example of the invention | 90 | 3.70 | 0.18 | 6 |
| 21 | Example of the invention | 90 | 3.71 | 0.18 | 6 |
| 22 | Comparative example | 81 | 3.10 | 0.18 | 6 |
| 23 | Comparative example | 85 | 3.50 | 0.18 | 6 |
| 24 | Comparative example | 85 | 3.51 | 0.18 | 6 |
| 25 | Comparative example | 99 | 4.31 | 0.23 | 10 |
| 26 | Comparative example | 103 | 4.81 | 0.23 | 10 |
| 27 | Comparative example | 103 | 4.82 | 0.23 | 10 |
| 28 | Comparative example | 110 | 3.49 | 0.20 | 10 |
| 29 | Example of the invention | 115 | 3.89 | 0.20 | 10 |
| 30 | Example of the invention | 115 | 3.90 | 0.20 | 10 |

TABLE 7

| Heat developable photosensitive material | Note | Relative sensitivity | Image density ($D_{max}$) | Fog ($D_{min}$) | Image preservation property (rate of change of $D_{min}$) |
|---|---|---|---|---|---|
| 31 | Comparative example | 108 | 3.54 | 0.32 | 32 |
| 32 | Comparative example | 112 | 3.94 | 0.32 | 32 |
| 33 | Comparative example | 112 | 3.95 | 0.32 | 32 |
| 34 | Comparative example | 102 | 3.53 | 0.25 | 16 |
| 35 | Example of the invention | 106 | 3.93 | 0.25 | 16 |
| 36 | Example of the invention | 106 | 3.94 | 0.25 | 16 |
| 37 | Comparative example | 100 | 3.52 | 0.23 | 13 |
| 38 | Example of the invention | 104 | 3.92 | 0.23 | 13 |
| 39 | Example of the invention | 104 | 3.93 | 0.23 | 13 |
| 40 | Comparative example | 98 | 3.51 | 0.21 | 11 |
| 41 | Example of the invention | 102 | 3.91 | 0.21 | 11 |
| 42 | Example of the invention | 102 | 3.92 | 0.21 | 11 |
| 43 | Comparative example | 90 | 3.50 | 0.19 | 9 |
| 44 | Example of the invention | 100 | 3.90 | 0.19 | 9 |
| 45 | Example of the invention | 100 | 3.91 | 0.19 | 9 |
| 46 | Comparative example | 93 | 3.44 | 0.18 | 8 |
| 47 | Example of the invention | 97 | 3.84 | 0.18 | 8 |
| 48 | Example of the invention | 97 | 3.85 | 0.18 | 8 |
| 49 | Comparative example | 88 | 3.32 | 0.18 | 7 |
| 50 | Example of the invention | 92 | 3.72 | 0.18 | 7 |
| 51 | Examples of the invention | 92 | 3.73 | 0.18 | 7 |
| 52 | Comparative example | 83 | 3.12 | 0.18 | 6 |
| 53 | Comparative example | 87 | 3.52 | 0.18 | 6 |
| 54 | Comparative example | 87 | 3.53 | 0.18 | 6 |
| 55 | Comparative example | 101 | 4.33 | 0.23 | 11 |
| 56 | Comparative example | 105 | 4.83 | 0.23 | 11 |
| 57 | Comparative example | 105 | 4.84 | 0.23 | 11 |
| 58 | Comparative example | 112 | 3.51 | 0.21 | 11 |
| 59 | Example of the invention | 117 | 3.91 | 0.21 | 11 |
| 60 | Example of the invention | 117 | 3.92 | 0.21 | 11 |

TABLE 8

| Heat developable photosensitive material | Note | Relative sensitivity | Image density ($D_{max}$) | Fog ($D_{min}$) | Image preservation property (rate of change of $D_{min}$) |
|---|---|---|---|---|---|
| 61 | Comparative example | 108 | 3.54 | 0.31 | 31 |
| 62 | Comparative example | 113 | 3.95 | 0.31 | 31 |
| 63 | Comparative example | 113 | 3.96 | 0.31 | 31 |

TABLE 8-continued

| Heat developable photosensitive material | Note | Relative sensitivity | Image density ($D_{max}$) | Fog ($D_{min}$) | Image preservation property (rate of change of $D_{min}$) |
|---|---|---|---|---|---|
| 64 | Comparative example | 102 | 3.53 | 0.24 | 15 |
| 65 | Example of the invention | 105 | 3.92 | 0.24 | 15 |
| 66 | Example of the invention | 106 | 3.94 | 0.24 | 15 |
| 67 | Comparative example | 100 | 3.52 | 0.22 | 12 |
| 68 | Example of the invention | 104 | 3.92 | 0.22 | 12 |
| 69 | Example of the invention | 104 | 3.93 | 0.22 | 12 |
| 70 | Comparative example | 98 | 3.51 | 0.20 | 10 |
| 71 | Example of the invention | 101 | 3.90 | 0.20 | 10 |
| 72 | Example of the invention | 101 | 3.91 | 0.20 | 10 |
| 73 | Comparative example | 90 | 3.50 | 0.19 | 9 |
| 74 | Example of the invention | 100 | 3.90 | 0.19 | 9 |
| 75 | Example of the invention | 100 | 3.91 | 0.19 | 9 |
| 76 | Comparative example | 93 | 3.42 | 0.19 | 8 |
| 77 | Example of the invention | 97 | 3.84 | 0.19 | 8 |
| 78 | Example of the invention | 98 | 3.86 | 0.19 | 8 |
| 79 | Comparative example | 88 | 3.32 | 0.18 | 7 |
| 80 | Example of the invention | 92 | 3.72 | 0.18 | 7 |
| 81 | Example of the invention | 92 | 3.73 | 0.18 | 7 |
| 82 | Comparative example | 83 | 3.12 | 0.18 | 6 |
| 83 | Comparative example | 88 | 3.53 | 0.18 | 6 |
| 84 | Comparative example | 88 | 3.54 | 0.18 | 6 |
| 85 | Comparative example | 101 | 4.33 | 0.24 | 11 |
| 86 | Comparative example | 106 | 4.84 | 0.24 | 11 |
| 87 | Comparative example | 106 | 4.85 | 0.24 | 11 |
| 88 | Comparative example | 112 | 3.51 | 0.20 | 10 |
| 89 | Example of the invention | 118 | 3.92 | 0.20 | 10 |
| 90 | Example of the invention | 118 | 3.93 | 0.20 | 10 |

TABLE 9

| Heat developable photosensitive material | Note | Relative sensitivity | Image density ($D_{max}$) | Fog ($D_{min}$) | Image preservation property (rate of change of $D_{min}$) |
|---|---|---|---|---|---|
| 91 | Comparative example | 107 | 3.53 | 0.31 | 31 |
| 92 | Comparative example | 111 | 3.93 | 0.31 | 31 |
| 93 | Comparative example | 112 | 3.95 | 0.31 | 31 |
| 94 | Comparative example | 101 | 3.52 | 0.24 | 15 |
| 95 | Example of the invention | 105 | 3.92 | 0.24 | 15 |
| 96 | Example of the invention | 105 | 3.93 | 0.24 | 15 |

TABLE 9-continued

| Heat developable photosensitive material | Note | Relative sensitivity | Image density ($D_{max}$) | Fog ($D_{min}$) | Image preservation property (rate of change of $D_{min}$) |
|---|---|---|---|---|---|
| 97 | Comparative example | 99 | 3.51 | 0.22 | 12 |
| 98 | Example of the invention | 103 | 3.91 | 0.22 | 12 |
| 99 | Example of the invention | 103 | 3.92 | 0.22 | 12 |
| 100 | Comparative example | 97 | 3.50 | 0.20 | 10 |
| 101 | Example of the invention | 100 | 3.89 | 0.20 | 10 |
| 102 | Example of the invention | 100 | 3.90 | 0.20 | 10 |
| 103 | Comparative example | 89 | 3.49 | 0.19 | 8 |
| 104 | Example of the invention | 99 | 3.89 | 0.19 | 8 |
| 105 | Example of the invention | 99 | 3.90 | 0.19 | 8 |
| 106 | Comparative example | 92 | 3.43 | 0.18 | 7 |
| 107 | Example of the invention | 96 | 3.83 | 0.18 | 7 |
| 108 | Example of the invention | 96 | 3.84 | 0.18 | 7 |
| 109 | Comparative example | 87 | 3.31 | 0.18 | 6 |
| 110 | Example of the invention | 92 | 3.72 | 0.18 | 6 |
| 111 | Example of the invention | 92 | 3.73 | 0.18 | 6 |
| 112 | Comparative example | 82 | 3.11 | 0.18 | 6 |
| 113 | Comparative example | 86 | 3.51 | 0.18 | 6 |
| 114 | Comparative example | 86 | 3.52 | 0.18 | 6 |
| 115 | Comparative example | 100 | 4.32 | 0.24 | 11 |
| 116 | Comparative example | 104 | 4.82 | 0.24 | 11 |
| 117 | Comparative example | 104 | 4.83 | 0.24 | 11 |
| 118 | Comparative example | 111 | 3.50 | 0.20 | 10 |
| 119 | Example of the invention | 117 | 3.91 | 0.20 | 10 |
| 120 | Example of the invention | 117 | 3.92 | 0.20 | 10 |

Tables 5 to 9 show that the heat developable photosensitive materials (5, 6, 8, 9, 11, 12, 14, 15, 17, 18, 20, 21, 29, 30, 35, 36, 38, 39, 41, 42, 44, 45, 47, 48, 50, 51, 59, 60, 65, 66, 68, 69, 71, 72, 74, 75, 77, 78, 80, 81, 89, 90, 95, 96, 98, 99, 101, 102, 104, 105, 107, 108, 110, 111, 119 and 120) of the invention give good results with respect to sensitivity, image density ($D_{max}$), fog ($D_{min}$) and image preservation property (rate of change of $D_{min}$).

At least one of sensitivity, image density, fog and image preservation property is insufficient in the comparative examples. Although good results were obtained in the heat developable photosensitive materials 25, 26, 27, 55, 56, 57, 85, 86, 87, 115, 116 and 117, the heat developable photosensitive materials of the invention are particularly excellent in that they give good results regardless of a small amount of applied silver.

What is claimed is:

1. A heat developable photosensitive material comprising at least a photosensitive silver halide, a non-photosensitive organic silver salt, a reducing agent for silver ions and a binder on one surface of a support, wherein the non-photosensitive organic silver salt contains 53 mol % to 85 mol % of silver behenate; and the total amount of silver of the non-photosensitive organic silver salt and photosensitive silver halide is 0.1 to 1.9 g/m$^2$; and the reducing agent includes at least one of polyphenol compounds represented by the following formula (1):

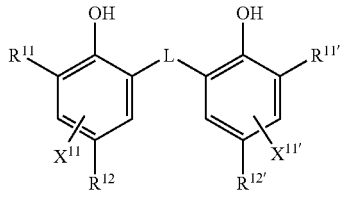

and any layer that is provided on a support side with the photosensitive silver halide contains an aromatic carboxylic acid compound represented by the following formula (2):

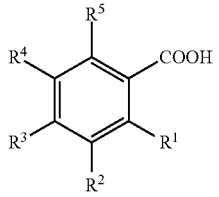

wherein in formula (1), each of $R^{11}$ and $R^{11'}$ represents a t-butyl group, each of $X^{11'}$ and $R^{12'}$ independently represents a hydrogen atom or group that can bond to a first benzene ring of the polyphenol compounds, and each of $X^{11}$ and $R^{12}$ independently represents a hydrogen atom or group that can bond to a second benzene ring of the polyphenol compounds; and $R^{11}$ and $X^{11}$, $R^{11'}$ and $X^{11'}$, $R^{12}$ and $X^{11}$, and $R^{12'}$ and $X^{11'}$, respectively, may bond to each other to form a ring; and L represents a —S— group or a —$CHR^{13}$— group; and $R^{13}$ represents a hydrogen atom or an alkyl group;

wherein in formula (2), each of $R^1$ to $R^5$ independently represents a hydrogen atom or group that can bond to a benzene ring; at least one of $R^1$ to $R^5$ represents a non-dissociating substituent that bonds to the benzene ring via a carbon atom, nitrogen atom, oxygen atom, sulfur atom or phosphorous atom; $R^1$ or $R^5$ represents an arylsulfonyloxy group; and $R^1$ to $R^5$ are not a carboxyl group or group having a carboxyl group; and wherein the amount of the at least one of polyphenol compounds is 0.2 to 1.8 g/$m^2$.

2. A heat developable photosensitive material according to claim 1, wherein each of $R^{11}$ and $R^{11'}$ independently is a secondary or tertiary alkyl group, each of $R^{12}$ and $R^{12'}$ independently is an alkyl group, L is a —S— group or —$CHR^{13}$— group, $R^{13}$ represents a hydrogen atom or an alkyl group, and both $X^{11}$ and $X^{11'}$ are hydrogen atoms in the compound represented by formula (1).

3. A heat developable photosensitive material according to claim 1, wherein each of $R^{11}$ and $R^{11'}$ independently is a tertiary alkyl group, each of $R^{12}$ and $R^{12'}$ independently is an alkyl group, L is a —S— group or —$CHR^{13}$— group, and $R^{13}$ represents an alkyl group in the compound represented by formula (1).

4. A heat developable photosensitive material according to claim 2, wherein each of $R^{11}$ and $R^{11'}$ independently is a tertiary alkyl group, each of $R^{12}$ and $R^{12'}$ independently is an alkyl group, L is a —S— group or —$CHR^{13}$— group, and $R^{13}$ represents an alkyl group in the compound represented by formula (1).

5. A heat developable photosensitive material according to claim 1, wherein each of $R^{11}$ and $R^{11'}$ independently is a tertiary alkyl group, each of $R^{12}$ and $R^{12'}$ independently is an alkyl group having at least 2 carbon atoms, L is a —S— group or —$CHR^{13}$— group, and $R^{13}$ represents a hydrogen atom or an alkyl group in the compound represented by formula (1).

6. A heat developable photosensitive material according to claim 2, wherein each of $R^{11}$ and $R^{11'}$ independently is a tertiary alkyl group, each of $R^{12}$ and $R^{12'}$ independently is an alkyl group having at least 2 carbon atoms, L is a —S— group or —$CHR^{13}$— group, and $R^{13}$ represents a hydrogen atom or an alkyl group in the compound represented by formula (1).

7. A heat developable photosensitive material according to claim 1, wherein $R^{11}$ and $R^{11'}$ are methyl groups, each of $R^{12}$ and $R^{12'}$ independently is an alkyl group, L is a —S— group or —$CHR^{13}$— group, and $R^{13}$ represents a secondary alkyl group in the compound represented by formula (1).

8. A heat developable photosensitive material according to claim 1, wherein a photosensitive layer contains the photosensitive silver halide, the non-photosensitive organic silver salt, the reducing agent for the silver ions, and the binder.

9. A heat developable photosensitive material according to claim 2, wherein a photosensitive layer contains the photosensitive silver halide, the non-photosensitive organic silver salt, the reducing agent for the silver ions, and the binder.

10. A heat developable photosensitive material according to claim 8, wherein the binder of the photosensitive layer contains 50 to 100% by mass of polyvinyl butyral relative to a total amount of the binder.

11. A heat developable photosensitive material according to claim 9, wherein the binder of the photosensitive layer contains 50 to 100% by mass of polyvinyl butyral relative to a total amount of the binder.

12. A heat developable photosensitive material according to claim 8, wherein Tg of the binder is 40° C. to 90° C.

13. A heat developable photosensitive material according to claim 10, wherein Tg of the binder is 40° C. to 90° C.

* * * * *